US007757486B2

(12) United States Patent
Ichimura

(10) Patent No.: US 7,757,486 B2
(45) Date of Patent: Jul. 20, 2010

(54) ENGINE CONTROL DEVICE FOR WORK VEHICLE

(75) Inventor: Kazuhiro Ichimura, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 517 days.

(21) Appl. No.: 11/663,847

(22) PCT Filed: Sep. 9, 2005

(86) PCT No.: PCT/JP2005/016627

§ 371 (c)(1),
(2), (4) Date: Sep. 6, 2007

(87) PCT Pub. No.: WO2006/035589

PCT Pub. Date: Apr. 6, 2006

(65) Prior Publication Data

US 2008/0254939 A1 Oct. 16, 2008

(30) Foreign Application Priority Data

Sep. 27, 2004 (JP) ..... 2004-279087

(51) Int. Cl.
*E02F 9/20* (2006.01)
*F02D 41/08* (2006.01)

(52) U.S. Cl. ..... 60/431; 180/272

(58) Field of Classification Search ..... 60/368, 60/431; 180/286, 272, 315
See application file for complete search history.

(56) References Cited

U.S. PATENT DOCUMENTS 5,410,878 A * 5/1995 Lee et al. ..... 60/431
6,694,240 B1 2/2004 Swick et al.
6,912,803 B2 * 7/2005 Ichimura ..... 60/420
7,500,535 B2 * 3/2009 Kamon et al. ..... 60/431

FOREIGN PATENT DOCUMENTS

JP 5-214995 A 8/1993
JP 05214995 A * 8/1993
JP 8-21285 A 1/1996
JP 08021285 A * 1/1996

(Continued)

OTHER PUBLICATIONS

International Search Report dated Oct. 25, 2005 with an English translation (Four (4) pages).

(Continued)

*Primary Examiner*—Thomas E Lazo
(74) *Attorney, Agent, or Firm*—Crowell & Moring LLP

(57) ABSTRACT

An engine control device for a work vehicle includes a hydraulic pump driven by an engine, a hydraulic actuator driven with pressure oil supplied from the hydraulic pump, a drive disallower for disallowing drive of the hydraulic actuator with the pressure oil supplied from the hydraulic pump, a disallowed drive detector for detecting whether or not the drive disallower is disallowing the drive; and a rotation rate controller for executing control so as to adjust an engine speed to a low rotation rate, lower than a minimum rotation rate (hereafter referred to as a low idle rotation rate) at which the hydraulic actuator can still be driven, at least when the disallowed drive detector detects that the drive disallower is disallowing the drive.

11 Claims, 13 Drawing Sheets

FOREIGN PATENT DOCUMENTS

Figure 1:
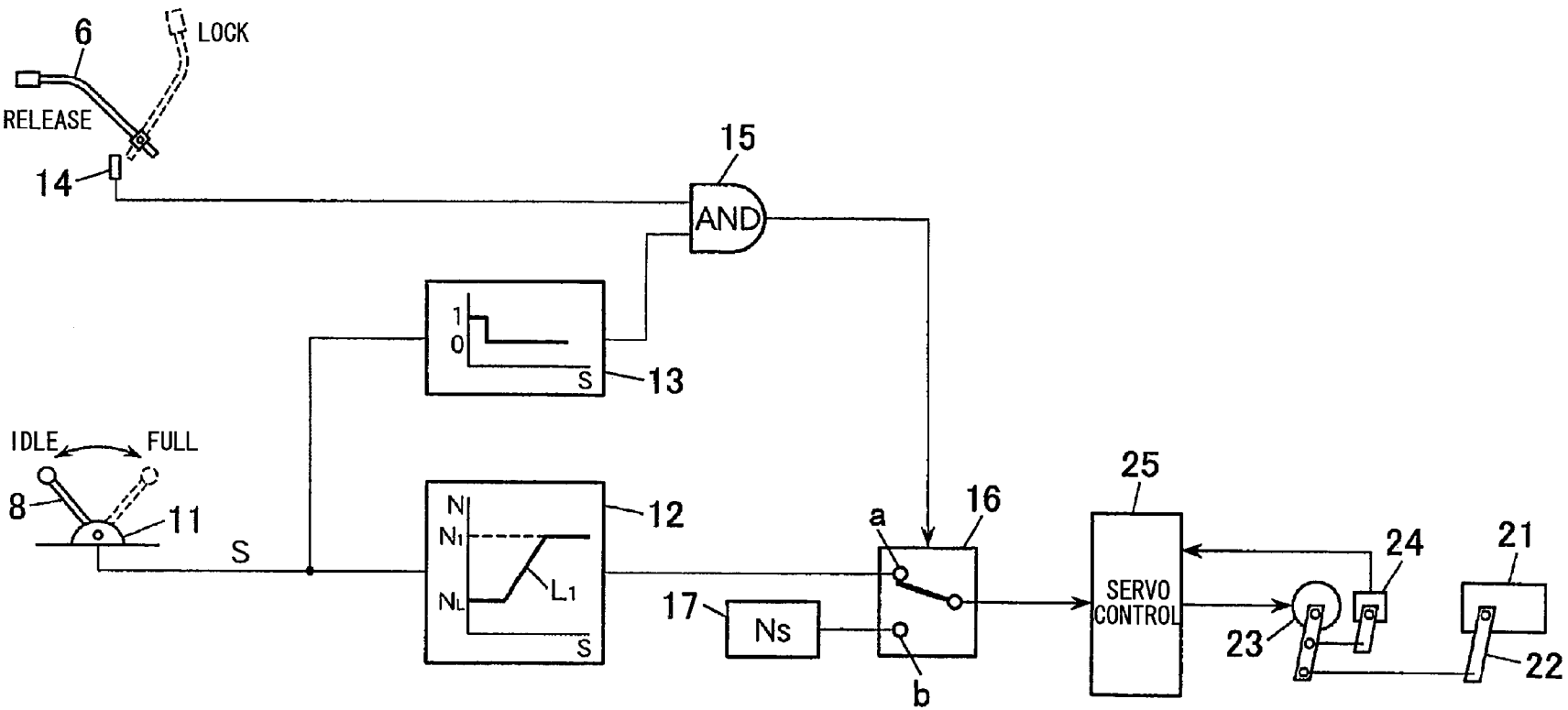

| | | | | |
|---|---|---|---|---|
| JP | 08158410 | A | * | 6/1996 |
| JP | 11-351007 | A | | 12/1999 |
| JP | 3073896 | B2 | | 6/2000 |
| JP | 2002-30954 | A | | 1/2002 |
| JP | 2002030954 | A | * | 1/2002 |

OTHER PUBLICATIONS

Extended European Search Report dated May 19, 2009 (Five (5) pages).

* cited by examiner

ENGINE CONTROL DEVICE FOR WORK VEHICLE

TECHNICAL FIELD

The present invention relates to an engine control device for a work vehicle such as a wheel hydraulic excavator.

BACKGROUND ART

There are devices known in the related art that reduce the engine speed to a predetermined rotation rate as an operating lever is shifted to a neutral position (see, for instance, patent reference literature 1). Such a device includes a lock mechanism for locking the operating lever at the neutral position, and as the operating lever is moved to the neutral position while the lock mechanism is in a released state, it executes control so as to adjust the engine speed to the predetermined rotation rate. While the lock mechanism is in an engaged state, it executes control so as to adjust the engine speed to a rotation rate (hereafter referred to as a low idle rotation rate) lower than the predetermined rotation rate. The low idle rotation rate, which represents an engine speed achieved by setting the engine accelerator position slightly above the idling position, is the minimum rotation rate at which the engine will not stall when a hydraulic actuator is driven.

Patent Reference Literature 1: Japanese Patent Publication No. 3073896

DISCLOSURE OF THE INVENTION

Problems to be Solved by the Invention

However, the device disclosed in the publication quoted above, which executes control so as to adjust the engine rotation rate at low idle while the lock mechanism is engaged, does not reduce the engine rotation rate to the full extent, and thus, there is still room left for further improvement in fuel efficiency.

Means for Solving the Problems

An engine control device for a work vehicle according to the present invention includes: a hydraulic pump driven by an engine; a hydraulic actuator driven with pressure oil supplied from the hydraulic pump; a drive disallowing means for disallowing drive of the hydraulic actuator with the pressure oil supplied from the hydraulic pump; a disallowed drive detection means for detecting whether or not the drive disallowing means is disallowing the drive; and a rotation rate control means for executing control so as to adjust an engine speed to a low rotation rate, lower than a minimum rotation rate (hereafter referred to as a low idle rotation rate) at which the hydraulic actuator can still be driven, at least when the disallowed drive detection means detects that the drive disallowing means is disallowing the drive.

It is possible to further include a rotation rate command issuing means for issuing a command indicating a rotation rate to be achieved for the engine within a range, a lower limit of which is equal to the low idle rotation rate, in response to an operation performed by an operator. In this engine control device, as the disallowed drive detection means detects that the drive disallowing means is disallowing the drive and the rotation rate command issuing means issues a command indicating the low idle rotation rate, the rotation rate control means may control the engine speed so as to adjust the rotation rate to the low rotation rate, and as the rotation rate command issuing means issues a command indicating a rotation rate higher than the low idle rotation rate, the rotation rate control means may control the engine speed so as to adjust the engine speed to the rotation rate indicated in the command.

It is possible to further include a braking device that applies a brake on the hydraulic actuator; and a braking detection means for detecting whether or not the braking device is engaged in operation. In this engine control device, as the disallowed drive detection means detects that the drive disallowing means is disallowing the drive, the rotation rate command issuing means issues a command indicating the low idle rotation rate and the braking detection means detects that the braking device is engaged in operation, the rotation rate control means may control the engine speed so as to adjust the engine speed to the low rotation rate.

It is possible to further include the hydraulic actuator constituted with a traveling motor that rotates in correspondence to an extent to which a traveling pedal has been operated; a traveling selection means for selecting one of a traveling-enabled state in which the traveling motor is allowed to rotate in response to an operation of the traveling pedal and a neutral state in which the traveling motor is not allowed to rotate; and a traveling control means for allowing a flow of pressure oil from the hydraulic pump to the traveling motor when the traveling-enabled state is selected via the traveling selection means and disallowing the flow of pressure oil from the hydraulic pump to the traveling motor when the neutral state is selected via the traveling selection means. In this engine control device, as the disallowed drive detection means detects that the drive disallowing means is disallowing the drive, the rotation rate command issuing means issues a command indicating the low idle rotation rate and the neutral state is selected via the traveling selection means, the rotation rate control means can control the engine speed so as to adjust the engine speed to the low rotation rate.

It is preferable to further include: a coolant temperature detection means for detecting an engine coolant temperature; and a first setting means for setting the low rotation rate in correspondence to the engine coolant temperature so as to adjust the low rotation rate to a higher setting as the engine coolant temperature detected by the coolant temperature detection means decreases, and it is preferable that when adjusting the engine speed to the low rotation rate, the rotation rate control means controls the engine speed so as to adjust the engine speed to the rotation rate set via the first setting means.

It is preferable to further include: a hydraulic fluid temperature detection means for detecting a hydraulic fluid temperature; and a second setting means for setting the low rotation rate in correspondence to the hydraulic fluid temperature so as to adjust the low rotation rate to a higher setting as the hydraulic fluid temperature detected by the hydraulic fluid temperature detection means decreases, and it is preferable that when adjusting the engine speed to the low rotation rate, the rotation rate control means controls the engine speed so as to adjust the engine speed to the rotation rate set via the second setting means.

A startup detection means for detecting a startup of the engine may be further provided, and the rotation rate control means may disallow a switchover of the engine speed to the low rotation rate until a predetermined length of time elapses after the startup detection means detects the startup of the engine and may allow the switchover to the low rotation rate once the predetermined length of time elapses after the startup detection means detects the startup of the engine.

A warm-up operation decision-making means for making a decision as to whether a warm-up operation at the engine has been completed may be further provided, and the rotation rate control means may disallow a switchover of the engine speed to the low rotation rate until the warm-up operation decision-making means determines that the warm-up operation has been completed and may allow the switchover to the low rotation rate once the warm-up operation decision-making means determines that the warm-up operation has been completed.

It is preferable that, if at least the disallowed drive detection means detects that the drive disallowing means is not disallowing the drive, the rotation rate control means controls the engine speed so as to adjust the engine speed to a preset rotation rate equal to or higher than the low idle rotation rate.

As the disallowed drive detection means detects that the drive disallowing means is not disallowing the drive while the engine speed is controlled at the low rotation rate, the rotation rate control means may gradually increase the engine speed to the rotation rate indicated in the command issued by the rotation rate command issuing means.

In this case, it is preferable that, when the rotation rate indicated in the command issued by the rotation rate command issuing means is equal to or higher than a preset rotation rate higher than the low idle rotation rate, the rotation rate control means gradually increases the engine speed to the rotation rate indicated in the command, whereas if the rotation rate indicated in the command is less than the preset rotation rate, the rotation rate control means immediately increases the engine speed to the rotation rate indicated in the command.

It is also possible that, as the disallowed drive detection means detects that the drive disallowing means is not disallowing the drive while the engine speed is controlled at the low rotation rate, the rotation rate control means controls the engine speed so as to adjust the engine speed to a preset rotation rate higher than the low idle rotation rate, as long as the rotation rate indicated in the command issued by the rotation rate command issuing means is equal to or higher than the preset rotation rate.

In this case, an actuator drive command issuing means for outputting a drive command for driving the hydraulic actuator may be further included, and it is preferable that the rotation rate control means controls the engine speed so as to adjust the engine speed to the preset rotation rate on condition that no drive command has been output from the actuator drive command issuing means and controls the engine speed so as to adjust the engine speed to the rotation rate indicated in the command once a drive command is output.

ADVANTAGES EFFECT OF THE INVENTION

According to the present invention, once the drive of the hydraulic actuator with the pressure oil from the hydraulic pump, at least, is disallowed, control is executed so as to adjust the engine speed at a rotation rate lower than the minimum rotation rate (low idle rotation rate) required to drive the hydraulic actuator. As a result, the engine speed can be set to a level lower than low idle when no significant load is applied on the hydraulic pump. Thus, further improvement in fuel efficiency is achieved and engine stall is effectively prevented.

Figure 5:
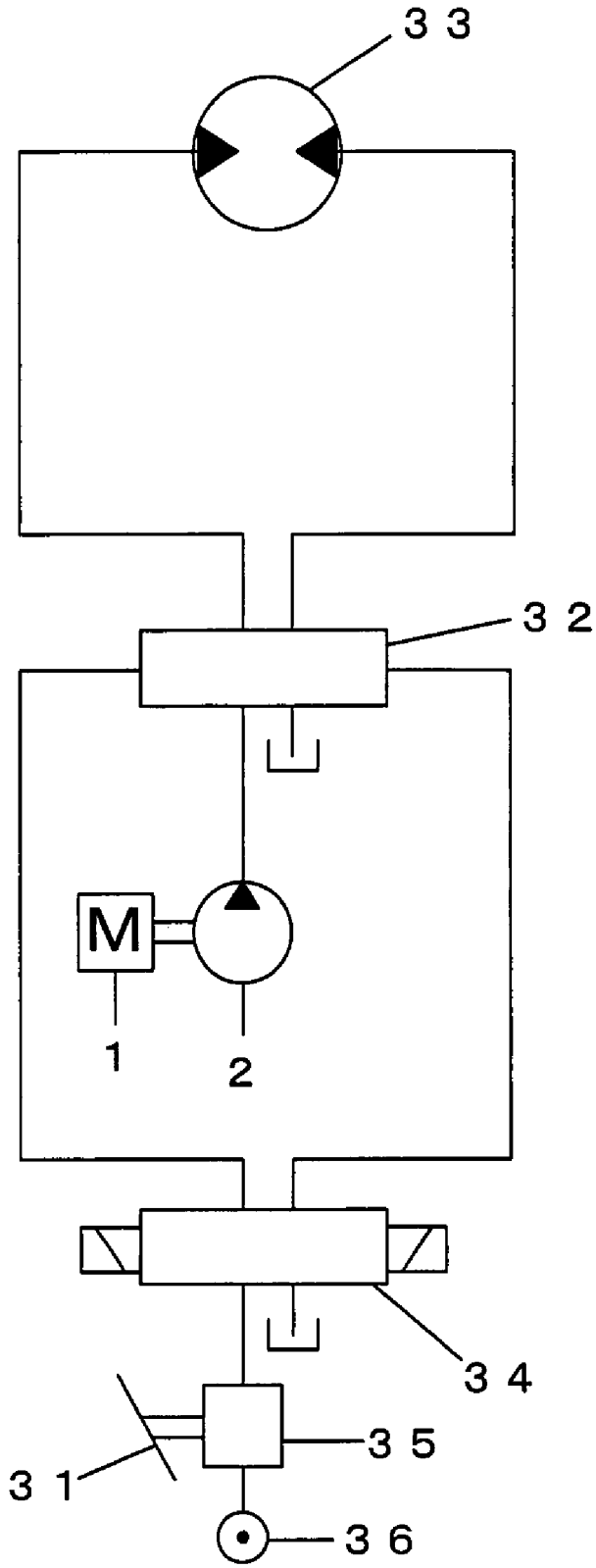
Figure 6:
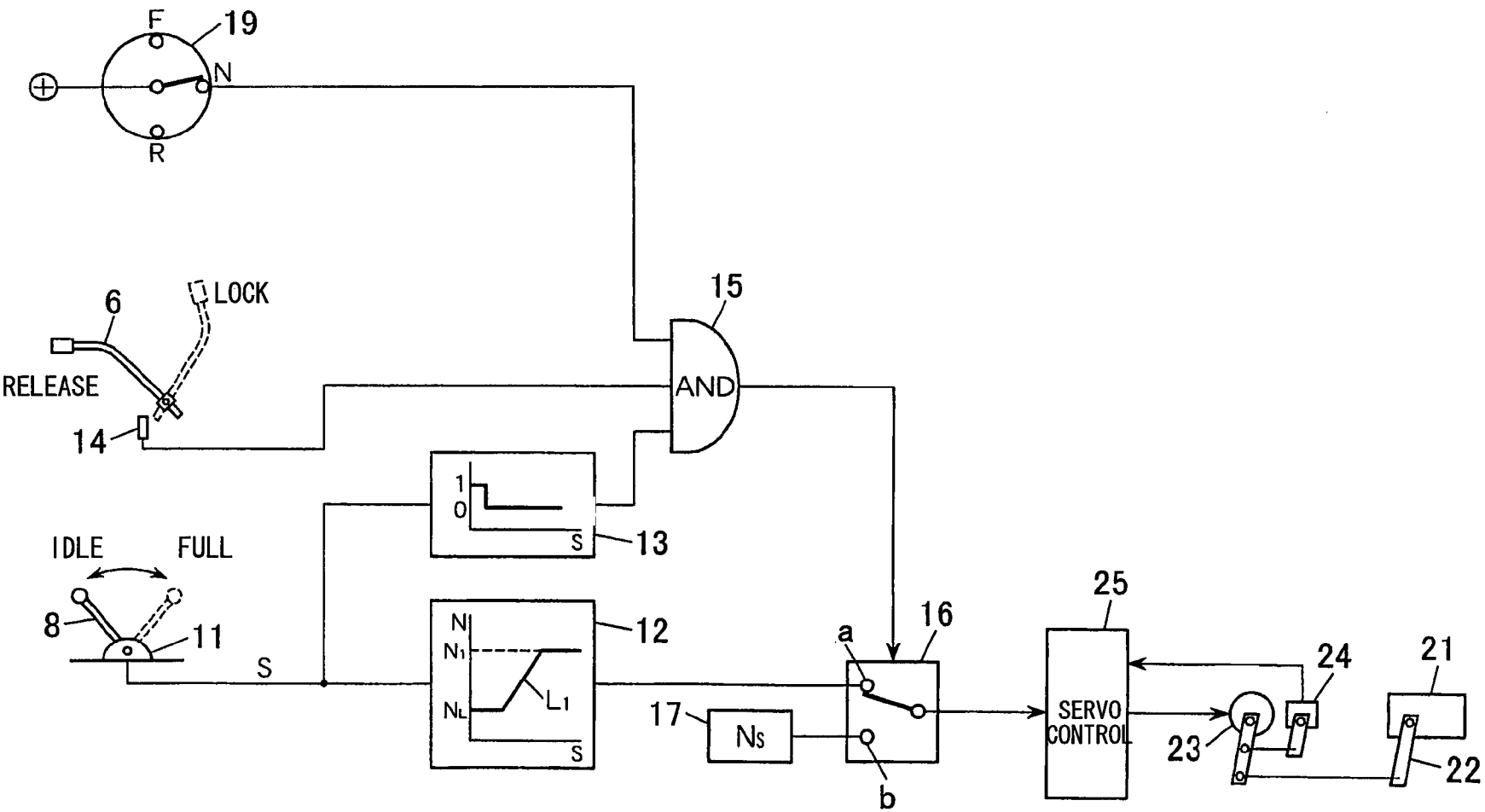

BRIEF DESCRIPTION OF THE DRAWINGS (FIG. 1) A block diagram of the structure adopted in an engine control device achieved in a first embodiment of the present invention (FIG. 2) A hydraulic circuit diagram of a hydraulic circuit engaged in operation to drive a hydraulic actuator mounted in a work vehicle in the first embodiment (FIG. 3) A hydraulic circuit diagram of the hydraulic circuit engaged in operation to drive a hydraulic actuator mounted in the work vehicle in a second embodiment (FIG. 4) A block diagram of the structure adopted in an engine control device achieved in the second embodiment of the present invention (FIG. 5) A hydraulic circuit diagram of a hydraulic circuit engaged in operation to drive a hydraulic actuator mounted in a work vehicle in a third embodiment (FIG. 6) A block diagram of the structure adopted in an engine control device achieved in the third embodiment of the present invention (FIG. 7) A variation of the device shown in FIG. 6

(FIG. 8) A block diagram of the structure adopted in an engine control device achieved in a fourth embodiment of the present invention (FIG. 9) A block diagram of the structure adopted in an engine control device achieved in a fifth embodiment of the present invention (FIG. 10) A variation of the device shown in FIG. 1

(FIG. 11) Another variation of the device shown in FIG. 1

(FIG. 12) A block diagram of the structure adopted in an engine control device achieved in a sixth embodiment of the present invention (FIG. 13) A flowchart of the processing executed in a slow-up processing circuit in FIG. 6

(FIG. 14) A block diagram of the structure adopted in an engine control device achieved in a seventh embodiment of the present invention

BEST MODE FOR CARRYING OUT THE INVENTION

First Embodiment

Figure 2:
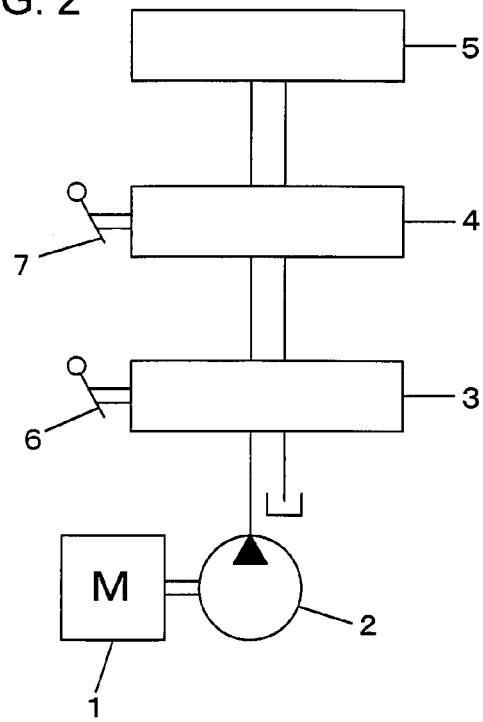

The following is an explanation of the first embodiment of an engine control device for a work vehicle according to the present invention, given in reference to FIGS. 1 and 2.

FIG. 1 is a block diagram showing the structure adopted in the engine control device achieved in the first embodiment. This engine control device is mounted at a work vehicle (such as a hydraulic excavator) that includes a hydraulic actuator.

FIG. 2 is a hydraulic circuit diagram of the hydraulic circuit engaged in operation to drive a hydraulic actuator 5. Pressure oil from a hydraulic pump 2 driven by an engine 1 is supplied to the hydraulic actuator 5 such as a hydraulic cylinder or a hydraulic motor via a lock valve 3 and a control valve 4. In a hydraulic excavator that includes, for instance, a crawler-type traveling device, hydraulic cylinders that drive work devices, such as a boom and an arm, and hydraulic motors that drive a revolving superstructure and a base carrier each constitute the hydraulic actuator 5. The lock valve 3, which is a two-position switching valve that can be switched to a continuous position to guide the pressure oil from the hydraulic pump 2 to the control valve 4 or a cutoff position to disallow the supply of pressure oil to the control valve 4, is switched in response to an operation of a gate lock lever 6. The gate lock lever 6, disposed at the entrance to an operator's cab, can be set to a release position at which it does not allow the operator to enter or exit the operator's cab or a lock position at which the operator is allowed to enter or exit the operator's cab. As the gate lock lever 6 is set to the release position, the lock valve 3 is switched to the continuous position, whereas as the gate lock lever 6 is set to the lock position, the lock valve 3 is switched to the cutoff position.

The control valve 4 is switched in response to an operation of an operating lever 7, so as to control the flow of pressure oil from the lock valve 3 to the hydraulic actuator 5. It is to be noted that the hydraulic circuit may adopt a structure other than that shown in FIG. 2. For instance, the hydraulic circuit may include the control valve 4 constituted with a hydraulic pilot switching valve to operate in conjunction with a pilot circuit that generates a pilot pressure corresponding to the extent to which the operating lever 7 has been operated so as to switch the control valve 4 based upon the pilot pressure corresponding to the extent to which the operating lever 7 has been operated. In such a case, the lock valve 3 may be disposed in the pilot circuit.

As shown in FIG. 1, a fuel lever 8, with which an engine speed command setting is issued, is disposed in the operator's cab. The fuel lever 8 can be operated over a range between the idle setting and the full setting, and the extent to which the fuel lever 8 has been operated (operation stroke quantity or operation angle) is detected with an operation quantity detector 11. A signal S from the operation quantity detector 11 is input to both a function generating circuit 12 and a signal generating circuit 13. The relationship (characteristics L1) of the target rotation rate N of the engine 1 to the operation quantity S is stored in advance at the function generating circuit 12 as shown in the figure, so as to enable the function generating circuit 12 to output the target rotation rate N corresponding to the operation quantity S. The characteristics L1 indicate that as the operation quantity S increases the target rotation rate N also increases in proportion from a low idle rotation rate NL to a rated rotation rate N1.

The term "low idle rotation rate NL" refers to the minimum rotation rate that may be set for the engine 1 without inducing an engine stall when any of the hydraulic actuators 5 is driven in response to an operation of the operating lever 7, and this minimum rotation rate may be set to, for instance, 1000 rpm. It is to be noted that the rated rotation rate N1 may be, for instance, 2000 rpm. As a command indicating the low idle rotation rate NL is issued via the fuel lever 8, the signal generating circuit 13 outputs a high signal, whereas it outputs a low signal in response to a command indicating a rotation rate higher than the low idle rotation rate NL.

A limit switch 14 is disposed at the gate lock lever 6 and the limit switch 14 enters an ON state as the gate lock lever 6 is operated to the lock position, whereas the limit switch 14 enters an OFF state in response to an operation of the gate lock lever 6 to the release position. Signals from the limit switch 14 and the signal generating circuit 13 are input to an AND circuit 15, which then switches a changeover circuit 16 in response to the signals input thereto. Namely, if a high signal is input from the signal generating circuit 13 and an ON signal is input from the limit switch 14, the AND circuit 15 switches the changeover circuit 16 to a terminal b. As a result, the changeover circuit 16 outputs as a target rotation rate a rotation rate NS (to be referred to as a super low idle rotation rate) set in advance at a setting circuit 17. If, on the other hand, a low signal is input from the signal generating circuit 13 or an OFF signal is input from the limit switch 14, the AND circuit 15 switches the changeover circuit 16 to a terminal a. In this case, the changeover circuit 16 outputs the target rotation rate provided from the function generating circuit 12.

The super low idle rotation rate NS is a low rotation rate that can be set for the engine 1 without inducing an engine stall even if the air-conditioning system or other accessory device is engaged in operation while the hydraulic pump 2 is in a no-load state in which the hydraulic actuators 5 are not driven. In this situation, control can be executed without having to take into consideration drive of the hydraulic actuators 5 and, accordingly, a rotation rate, e.g., 600 rpm, lower than the low-rotation rate NL explained earlier, is set as the super low idle rotation rate NS. At this rotation rate, an engine stall will occur if a load resulting from drive of a hydraulic actuator 5 is applied to the engine 1. In other words, it can be lower than the low idle rotation rate NL by an extent corresponding to the output required to drive the hydraulic actuators 5.

A governor 21 of the engine 1 is connected to a pulse motor 23 via a link mechanism 22, and the engine speed is controlled in correspondence to the rotation of the pulse motor 23. In addition, a potentiometer 24 is connected to the governor 21 via the link mechanism 22, and a governor lever angle corresponding to the engine speed, detected with the potentiometer 24, is output to a servo control circuit 25. The servo control circuit 25 outputs a control signal to the pulse motor 23 to control the rotation of the pulse motor 23 so as to adjust the rotation rate detected via the potentiometer 24 to the target rotation rate output from the changeover circuit 16.

Next, the main operations of the engine control device achieved in the first embodiment are explained.

When engaging the vehicle in work operation, the operator sets the gate lock lever 6 to the release position. The lock valve 3 is thus switched to the continuous position (the lock valve enters a non-operating state) so as to allow drive of the hydraulic actuator 5 in response to an operation of the operating lever 7. At the same time, the limit switch 14 enters an OFF state and the changeover circuit 16 is switched to the terminal a. As result, the target rotation rate N corresponding to the operation quantity corresponding to the extent to which the fuel lever 8 has been operated is output from the changeover circuit 16 and the servo control circuit 25 executes control so as to adjust the engine speed to the target rotation rate N. For instance, in response to an operation of the fuel lever 8 to the idle position, control may be executed so as to adjust the engine speed to the low idle rotation rate NL, whereas control may be executed so as to adjust the engine speed to the rated rotation rate N1 in response to an operation of the fuel lever to the full position.

When entering a non-working state such as when interrupting the work, the operator operates the gate lock lever 6 to the lock position. As a result, the lock valve 3 is switched to the cutoff position (the lock valve is engaged), drive of the hydraulic actuators 5 in response to an operation of the operating lever 7 is disallowed and the limit switch 14 enters an ON state. If the fuel lever 8 is operated to the idle position under these circumstances, the changeover circuit 16 is switched to the terminal b. Consequently, the super low idle rotation rate NS is output as the target rotation rate from the changeover circuit 16 so as to control the engine speed to adjust it to the super low idle rotation rate NS. This results in better fuel efficiency and reduced engine noise. Under the control executed as described above, even if the operating lever 7 is operated by mistake, no pressure oil from the hydraulic pump 2 is supplied to the hydraulic actuator 5 and thus, an engine stall due to insufficient engine output does not occur.

When resuming the work having been interrupted, the operator operates the gate lock lever 6 to the release position while keeping the fuel lever 8 at the idle position. In response, the limit switch 14 enters an OFF state, the changeover circuit 16 is switched to the terminal a and the engine speed is controlled at the low idle rotation rate NL. Next, the operator operates the fuel lever 8 toward the full side and after raising the engine speed to a level corresponding to the extent to which the fuel lever has been operated, he operates the operating lever 7 to drive the hydraulic actuators 5. As a result, the work can be performed with a sufficient engine output and engine stall is prevented. It is to be noted that the hydraulic actuators 5 can also be driven without inducing an engine stall by operating the operating lever 7 with the fuel lever 8 set at the idle position after setting the gate lock lever 6 to the release position.

If the fuel lever 8 is operated toward the full side before the gate lock lever 6 is operated to the release position, the changeover circuit 16 is switched to the terminal a and control is executed so as to adjust the engine speed to the rotation rate corresponding to the operation quantity corresponding to the extent to which the fuel lever 8 is operated. As the gate lock lever 6 is operated to the release position and the operating lever 7 is operated in this state, pressure oil is supplied to the hydraulic actuators 5 and thus, the hydraulic actuators 5 are driven without inducing an engine stall. Namely, regardless of whether the gate lock lever 6 or the fuel lever 8 is first operated, the engine speed is set at least equal to or higher than the low idle rotation rate NL whenever the operating lever 7 is operated. In other words, since the pressure oil is never supplied to the hydraulic actuators 5 if the engine speed is at the super low idle rotation rate NS, the work can be performed without inducing an engine stall.

The following operations and advantageous effects can be achieved in the first embodiment described above.

(1) If a non-working state in which the pressure oil cannot be supplied to the hydraulic actuators 5 is detected, control is executed so as to adjust the engine speed to the lowest possible level (super low idle rotation rate NS) at which the air-conditioning system, auxiliary devices, the pump in a no-load state and the like can at least be driven. As a result, better fuel efficiency is achieved and, at the same time, noise can be reduced.

(2) As the lock valve 3 is switched to the cutoff position (the lock valve is engaged) in response to an operation of the gate lock lever 6, control is executed so as to adjust the engine speed to the super low idle rotation rate NS. Thus, no pressure oil is supplied to the hydraulic actuators 5 when the engine speed is at the super low idle rotation rate and an engine stall, is effectively prevented.

(3) As the gate lock lever 6 is operated to the lock position and the fuel lever 8 is operated to the idle position, control is executed on the engine speed so as to adjust, it to the super low idle rotation rate NS. In other words, the engine speed is adjusted to the super low idle rotation rate NS only when the minimum rotation rate is requested through an operation of the fuel lever 8 under this control, and it is thus ensured that the engine speed does not decrease too much.

Second Embodiment

Figure 3:
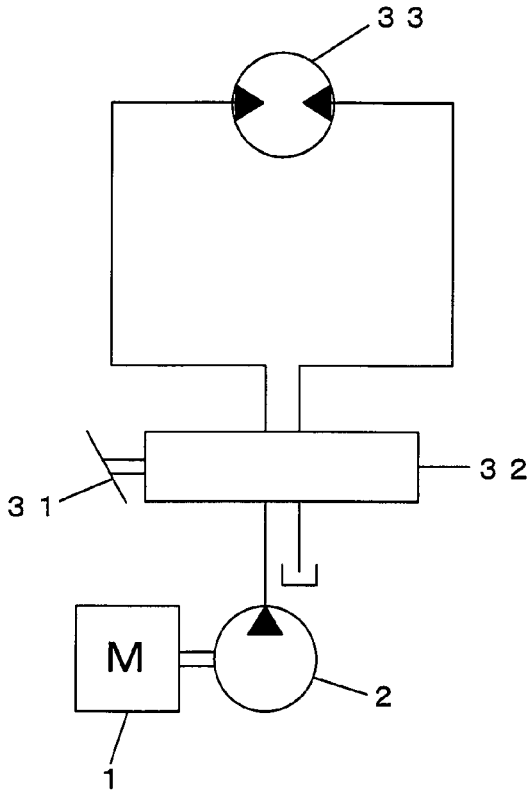
Figure 4:
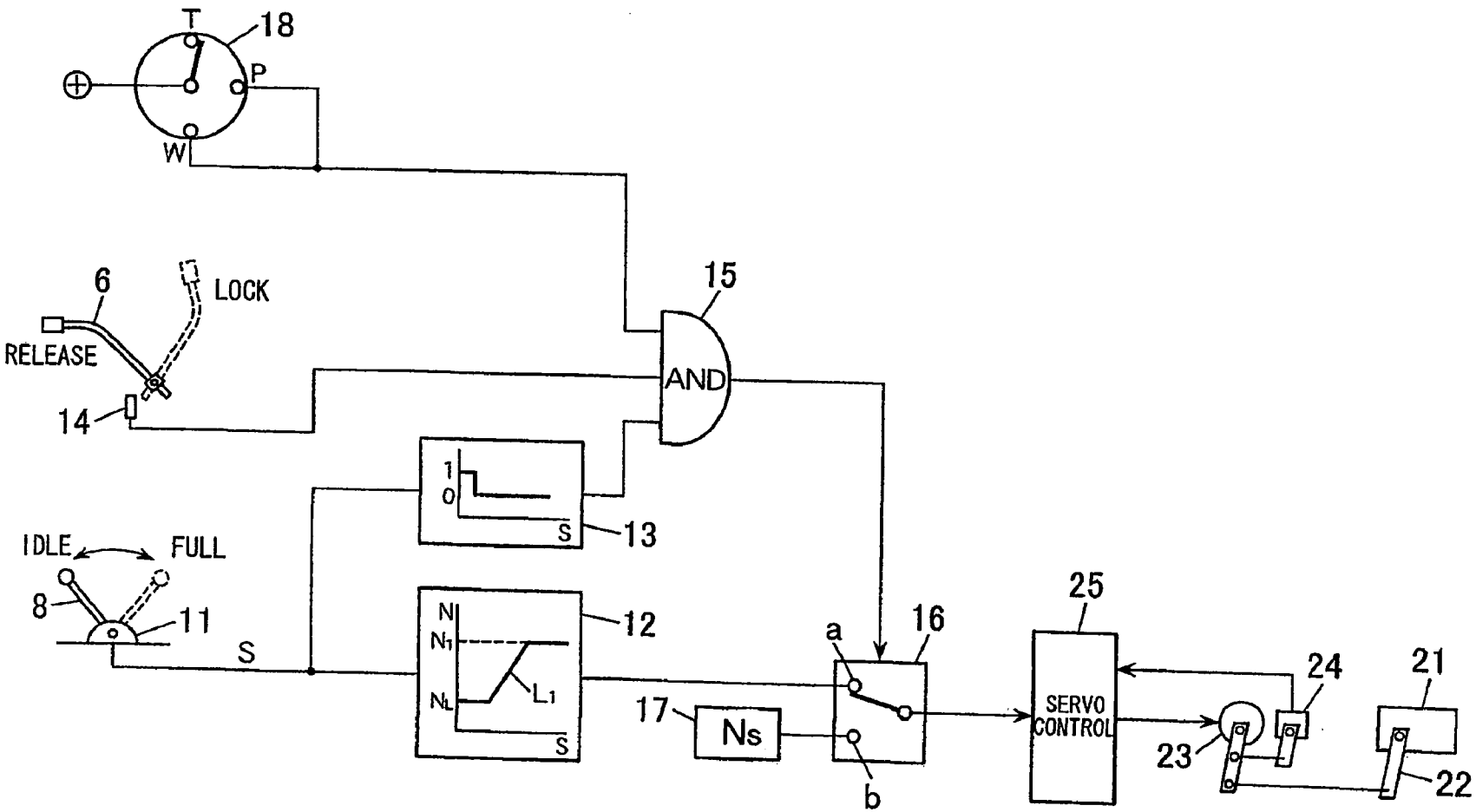

The second embodiment of the engine control device for a work vehicle according to the present invention is explained in reference to FIGS. 3 and 4.

Hydraulic cylinders and hydraulic motors engaged in work operation and a hydraulic motor engaged in traveling operation (hereafter to be referred to as a traveling motor) each constitute a hydraulic actuator 5 in the second embodiment. The hydraulic cylinders and the hydraulic motors engaged in work operation are each set in an operating state or a non-operating state via the lock valve 3 and the gate lock lever 6 as explained earlier, whereas the traveling motor is set in a traveling state or a non-traveling state via, for instance, a brake switch 18 to be detailed later. Such hydraulic actuators may be mounted in, for instance, a wheel hydraulic excavator.

FIG. 3 is a hydraulic circuit diagram of a traveling hydraulic circuit in a work vehicle (e.g., a wheel hydraulic excavator) in which the engine control device achieved in the second embodiment may be adopted. A traveling pedal 31 in FIG. 3 can be operated by depressing it on the front side (frontward depression) or depressing it on the rear-side (rearward depression). In response to a frontward depression of the traveling pedal 31, a directional control valve 32 is switched to the forward traveling position and, with the pressure oil from the hydraulic pump 2 supplied to a traveling motor 33, the vehicle is driven to travel forward. In response to a rearward depression of the traveling pedal 31, the directional control valve 32 is switched to the reverse traveling position and the vehicle is driven to travel in the reverse direction. If the traveling pedal 31 is depressed while the engine speed is controlled at the super low idle rotation rate NS mentioned earlier, the engine of the vehicle may stall due to the load applied to the hydraulic pump 2. Accordingly, an engine stall is prevented as detailed below in the second embodiment.

FIG. 4 is a block diagram showing the structure adopted in the engine control device achieved in the second embodiment. It is to be noted that the same reference numerals are assigned to components identical to those in FIG. 1 and that the following explanation focuses on differences from the first embodiment.

As shown in FIG. 4, the limit switch 14, the signal generating circuit 13 and the brake switch 18 are connected to the AND circuit 15. As the brake switch 18, which can be set to a traveling position, a work position or a parking position, is switched to the traveling position (T terminal), a work break and a parking brake (neither shown) are both released. As the brake switch 18 is switched to the parking position (P terminal), the parking brake is engaged, whereas as it is switched to the work position (W terminal), the work break is engaged. Signals from the P terminal and the W terminal at the brake switch 18, i.e., signals indicating the break operating states, are input to the AND circuit 15. The brake switch 18 controls the operating/non-operating status of the traveling motor 33.

If a high signal is input from the signal generating circuit 13, an ON signal is input from the limit switch 14 and a signal from the P terminal or the W terminal at the brake switch 18 is input, the AND circuit 15 switches the changeover circuit 16 to the terminal b. As a result, the changeover circuit 16 outputs the super low idle rotation rate NS as the target rotation rate. If a low signal is input from the signal generating circuit 13, if an OFF signal is input from the limit switch 14 or if no signal from either the P terminal or the W terminal at the brake switch is input (if the brake switch 18 is switched to the T terminal), the AND circuit 15 switches the changeover circuit 16 to the terminal a. In this case, the changeover circuit 16 outputs the target rotation rate provided from the function generating circuit 12.

In the second embodiment, when the work operation and the traveling operation are both disallowed, i.e., when the gate lock lever 6 is set at the lock position (the lock valve is engaged), the fuel lever 8 is set at the idle position and the brake switch 18 is switched to the parking position or the work position (brake is engaged), the changeover circuit 16 is switched to the terminal b to adjust the engine speed to the super low idle rotation rate NS. This means that the traveling motor 33 does not rotate even if the traveling pedal 31 is depressed when an engine speed is at the below super low idle rotation rate NS. Thus, since no load is applied to the hydraulic pump 2, an engine stall does not occur.

In order to enable the vehicle in this state to start traveling, the operator switches the brake switch 18 to the traveling position. In response, the changeover circuit 16 is switched to the terminal a and control is executed on the engine speed to adjust it to the rotation rate corresponding to the extent to which the fuel lever 8 has been operated. Thus, the engine speed is set to a level at least equal to or higher than the low idle rotation rate NL, thereby effectively preventing an engine stall from occurring during the traveling operation. It is to be noted that a relationship whereby the target rotation rate increases as the operation quantity of the traveling pedal 31 increases may be set in advance and that the engine speed may be controlled in conformance to this relationship when the brake switch 18 is switched to the traveling position.

Third Embodiment

Figure 7:
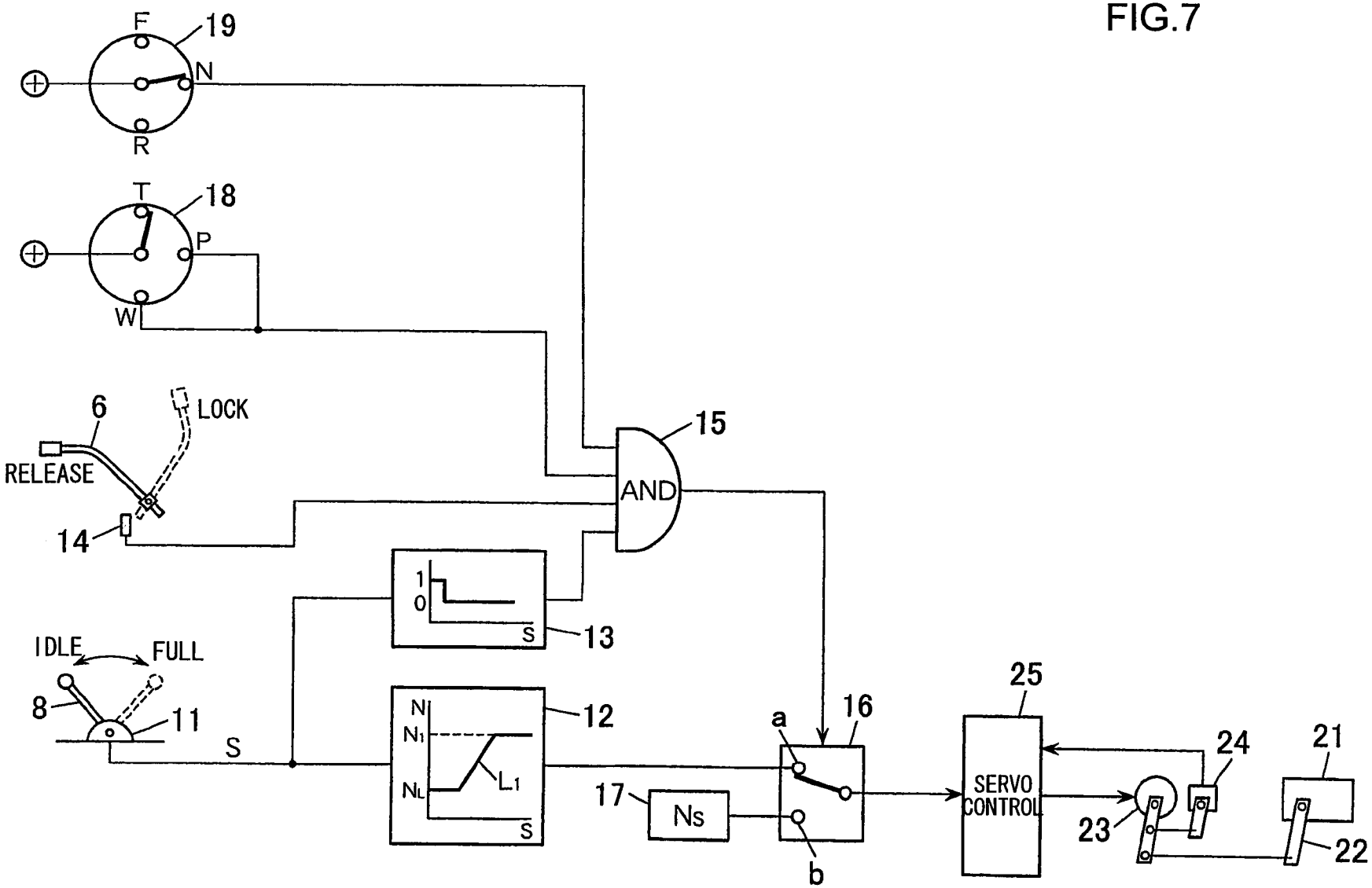

The third embodiment of the engine control device for a work vehicle according to the present invention is explained in reference to FIGS. 5~7.

FIG. 5 is a hydraulic circuit diagram of a traveling hydraulic circuit in a work vehicle in which the engine control device achieved in the third embodiment may be adopted. While the present invention is adopted in a work vehicle in which pressure oil is supplied to the traveling motor 33 in response to a forward depression or a rearward depression of the traveling pedal 31 in the second embodiment, the present invention as achieved in the third embodiment is adopted in a work vehicle in which pressure oil is supplied to the traveling motor 33 in response to a depression of the traveling pedal 31 and a changeover operation at a forward/reverse switching valve 34.

The forward/reverse switching valve 34 (solenoid controlled directional control valve) can be switched to a forward position, a reverse position or a neutral position in response to an operation of a forward/reverse changeover switch 19 (see FIG. 6). The directional control valve 32 is a hydraulic pilot switching valve. As the traveling pedal 31 is operated while the forward/reverse switching valve 34 is set at the forward position or the reverse position, a pilot valve 35 is driven in correspondence to the extent to which the traveling pedal 31 is operated, and pressure oil (pilot pressure) from a hydraulic source 36 is supplied to a pilot port at the directional control valve 32. As a result, the directional control valve 32 is switched to the forward side or the reverse side, the pressure oil from the hydraulic pump 2 is supplied to the traveling motor 33 and the vehicle thus travels forward or backward. While the forward/reverse switching valve 34 is set at the neutral position, the pilot pressure is not applied to the directional control valve 32 and the traveling motor 33 is not driven even if the traveling pedal 31 is operated.

FIG. 6 is a block diagram showing the structure adopted in the engine control device achieved in the third embodiment. It is to be noted that the same reference numerals are assigned to components identical to those in FIG. 3 and the following explanation focuses on differences from the second embodiment.

As shown in FIG. 6, the forward/reverse changeover switch 19, instead of the brake switch 18, is connected to the AND circuit 15 in the third embodiment. As the forward/reverse changeover switch 19, which can be switched to a forward position, a reverse position or a neutral position, is set to the forward position (F terminal) or the reverse position (R terminal), the forward/reverse switching valve 34 is switched to the forward position or the reverse position, thereby enabling a forward traveling operation or a reverse traveling operation in response to an operation of the traveling pedal 31. When the forward/reverse changeover switch is switched to the neutral position (N terminal), the forward/reverse switching valve 34 is switched to the neutral position and a traveling operation in response to an operation of the traveling pedal 31 is disabled. A signal from the N terminal at the forward/reverse changeover switch 19, i.e., a signal indicating the traveling disabled state, is input to the AND circuit 15.

If a high signal is input from the signal generating circuit 13, and ON signal is input from the limit switch 14 and a signal from the N terminal at the forward/reverse changeover switch 19 is input, the AND circuit 15 switches the changeover circuit 16 to the terminal b. As a result, the changeover circuit 16 outputs the super low idle rotation rate NS as the target rotation rate. If, on the other hand, a low signal is input from the signal generating circuit 13, if an OFF signal is input from the limit switch 14 or if the signal from the N terminal at the forward/reverse changeover switch 19 is not input (the forward/reverse changeover switch is set at the F terminal or the R terminal), the AND circuit 15 switches the changeover circuit 16 to the terminal a. Consequently, the changeover circuit 16 outputs the target rotation rate provided from the function generating circuit 12.

In the third embodiment, when the work operation and the traveling operation are both disallowed, i.e., when the gate lock lever 6 is set at the lock position (the lock valve is engaged), the fuel lever 8 is set at the idle position and the forward/reverse changeover switch 19 is set at the neutral position (the forward/reverse switching valve is set at the neutral position), the changeover circuit 16 is switched to the terminal b so as to control the engine speed at the super low idle rotation rate NS. Thus, it is ensured that the traveling motor 33 does not rotate even if the traveling pedal 31 is operated while the engine speed is at the super low idle rotation rate NS, and with no load applied to the hydraulic pump 2, an engine stall does not occur.

In order to enable the vehicle in this state to start traveling, the operator switches the forward/reverse changeover switch 19 to the forward position or the reverse position. In response, the changeover circuit 16 is switched to the terminal a, and control is executed so as to adjust the engine speed to the rotation rate corresponding to the operation quantity corresponding to the extent to which the fuel lever 8 has been operated. As a result, the engine speed is set to a level at least equal to or higher than the low idle rotation rate NL, thereby effectively preventing an engine stall from occurring during the traveling operation. It is to be noted that a relationship whereby the target rotation rate increases as the operation quantity of the traveling pedal 31 increases may be set in advance and that the engine speed may be controlled in conformance to this relationship when the forward/reverse changeover switch 19 is switched to the forward position or the reverse position.

As shown in FIG. 7, the forward/reverse changeover switch 19 and the brake switch 18 may be individually connected to the AND circuit 15 and, in this case, the changeover circuit 16 may be switched to the terminal b if a high signal is input from the signal generating circuit 13, an ON signal is input from the limit switch 14, a signal from the P terminal or the W terminal at the brake switch 18 is input and a signal from the N terminal at the forward/reverse changeover switch 19 is input to the AND circuit 15. Since the engine speed is not set to the super low idle rotation rate NS even when the brake is engaged, as long as the forward/reverse changeover switching valve 34 is not switched to the neutral position, an engine stall can be prevented with a high level of reliability.

Fourth Embodiment

Figure 8:
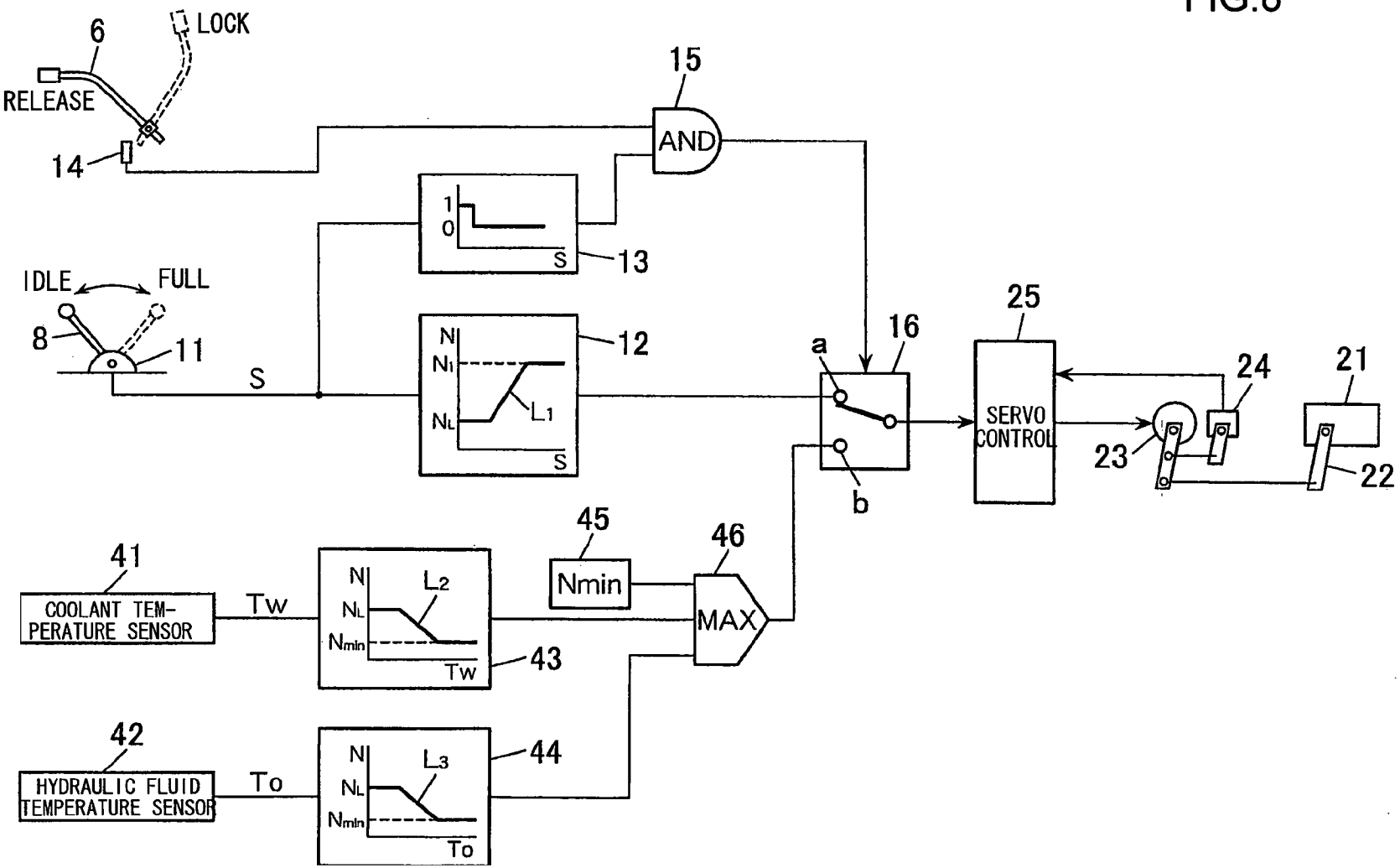

In reference to FIG. 8, the fourth embodiment of the engine control device for a work vehicle according to the present invention is explained.

In the fourth embodiment, a super low idle rotation rate NS is corrected in correspondence to the engine coolant temperature and the hydraulic fluid temperature. Namely, when the engine coolant temperature is low, the engine 1 will not have been warmed up yet and thus, a full engine output is not achieved. In addition, when the hydraulic fluid temperature is low, the oil viscosity is still high and thus, the pump load is high. Accordingly, since an engine stall tends to occur more readily under these circumstances, the super low idle rotation rate NS is corrected to a higher value.

FIG. 8 is a block diagram showing the structure adopted in the engine control device achieved in the fourth embodiment. It is to be noted that the same reference numerals are assigned to components identical to those in FIG. 1 and that the following explanation focuses on differences from the first embodiment.

As shown in FIG. 8, the engine control device achieved in the fourth embodiment includes a coolant temperature sensor 41 that detects the engine coolant temperature and a hydraulic fluid temperature sensor 42 that detects the hydraulic fluid temperature. Signals provided by the sensors 41 and 42 are respectively input to function generating circuits 43 and 44. At the function generating circuit 43, the relationship (characteristics L2) of the target speed of the engine 1 to the engine coolant temperature is stored in advance as shown in the figure, whereas the relationship (characteristics L3) of the target speed of the engine 1 to the hydraulic fluid temperature is stored in advance at the function generating circuit 44, as shown in the figure. The characteristics L2 indicate that as the engine coolant temperature increases, the target rotation rate decreases from the low idle rotation rate NL to a minimum rotation rate Nmin, whereas the characteristics L3 indicate that as the hydraulic fluid temperature increases, the target rotation rate decreases from the low idle rotation rate NL to the minimum rotation rate Nmin. It is to be noted that the minimum rotation rate Nmin is equivalent to the super low idle rotation rate NS in the first embodiment, i.e., the super low idle rotation rate selected without taking into consideration the engine coolant temperature or the hydraulic fluid temperature.

A maximum value selection circuit 46 selects the largest value among the minimum rotation rate Nmin set at a setting circuit 45 and the target rotation rates output from the individual function generators 43 and 44 as a correction value for the super low idle rotation rate NS. The AND circuit 15 switches the changeover circuit 16 to the terminal b as the gate lock lever 6 is set to the lock position and the fuel lever 8 is set to the idle position. As a result, control is executed so as to adjust the engine speed to the rotation rate selected via the maximum value selection circuit 46. If, on the other hand, the gate lock lever 6 is operated to the release position or if the fuel lever 8 is operated to a position other than the idle position, the changeover circuit 16 is switched to the terminal a. In this case, control is executed so as to adjust the engine speed to the rotation rate corresponding to the extent to which the fuel lever 8 has been operated.

In the fourth embodiment, the function generating circuits 43 and 44 respectively output target rotation rates corresponding to the coolant temperature and the hydraulic fluid temperature when the engine coolant temperature or the hydraulic fluid temperature is lower than normal due to specific weather conditions or due to conditions particular to a given worksite, and the maximum value selection circuit 46 selects the larger target rotation rate. As a result, when the coolant temperature or the hydraulic fluid temperature is low and thus the load applied to the engine is significant, the super low idle rotation rate NS is corrected to a higher value corresponding to the lower temperature, which makes it possible to prevent an engine stall with a high level of reliability.

As described above, the super low idle rotation rate NS is adjusted to a higher setting when the engine coolant temperature and the hydraulic fluid temperature are lower, i.e., when a significant load tends to be applied readily to the engine 1. As a result, better fuel efficiency and noise reduction are achieved while effectively preventing an engine stall.

It is to be noted that while the changeover circuit 16 is switched in response to operations of the gate lock lever 6 and the fuel lever 8 in the control device shown in FIG. 8, the changeover circuit 16 may also be switched in response to an operation of the brake switch 18 or the forward/reverse changeover switch 19 described earlier in reference FIGS. 4, 6 and 7, and in response to operations of the gate lock lever 6 and the fuel lever 8.

Fifth Embodiment

Figure 9:
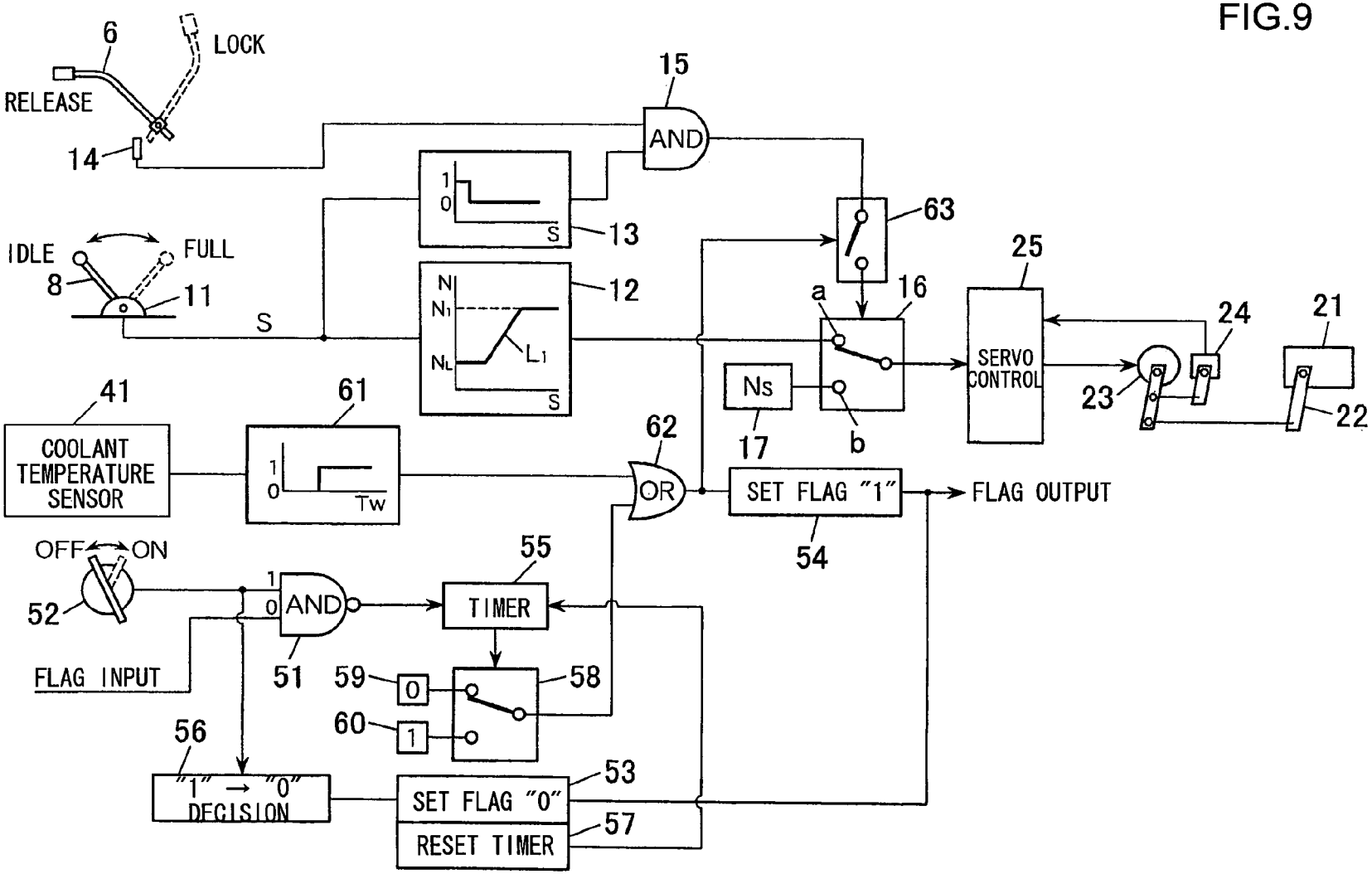

In reference to FIG. 9, the fifth embodiment of the engine control device for a work vehicle according to the present invention is explained.

In the fifth embodiment, if the engine coolant temperature is low, the engine speed cannot be set to the super low idle rotation rate NS at engine startup. Namely, if the engine 1 is started up by turning on the engine ignition switch while the temperature of the engine coolant is still low and the idle rotation rate is set to a low setting even though the engine speed has not yet stabilized, an engine stall may occur. Accordingly, the engine speed is not set to the super low idle rotation rate NS under such circumstances.

FIG. 9 is a block diagram showing the structure adopted in the engine control device achieved in the fifth embodiment. It is to be noted that the same reference numerals are assigned to components identical to those in FIG. 1 and that the following explanation focuses on differences from the first embodiment.

A signal from an engine ignition switch 52, i.e., an OFF signal (0) or an ON signal (1) from the engine ignition switch, as well as a flag 0 set via a flag set circuit 53 or a flag 1 set via a flag set circuit 54, is input to an AND circuit 51. As the ON signal (1) from the engine ignition switch 52 and the flag 0 are input to the AND circuit 51, a timer 55 starts a count. A decision-making circuit 56 makes a decision with regard to whether or not the engine ignition switch 52 has shifted from an ON state to an OFF state, i.e., whether or not the shift from the flag 1 to the flag 0 is to occur, and if an affirmative decision is made, the flag set circuit 53 sets the flag 0 and a reset circuit 57 resets the timer 55.

A changeover circuit 58 remains switched to a signal generating circuit 59 until a specific length of time is counted at the timer 55 and it is then switched to a signal generating circuit 60 once the predetermined length of time is counted. It is to be noted that the predetermined length of time represents the length of time required by the engine to achieve a speed at which an engine stall does not occur even if it is lowered to the super low idle rotation rate NS, and this length of time may be, for instance, approximately 15 minutes. The signal generating circuit 59 outputs a low signal (0) and the signal generating circuit 60 outputs a high signal (1).

A signal generating circuit 61 outputs a high signal (1) when the temperature detected with the coolant temperature sensor 41 is equal to or higher than a predetermined level and outputs a low signal (0) if the temperature is lower than the predetermined level. It is to be noted that an engine coolant temperature at which an engine stall does not occur even if the engine speed is lowered to the super low idle rotation rate NS, i.e., an engine coolant temperature detected when the warm-up operation is almost completed, is selected for the value indicating the predetermined level. Signals from the signal generating circuit 61 and the changeover circuit 58 are input to an OR circuit 62. As a high signal provided by at least either the signal generating circuit 61 or the changeover circuit 58 is input to the OR circuit 62, a changeover switch 63 enters an ON state and the flag set circuit 54 sets the flag 1. As a result, the changeover circuit 16 is switched to the terminal b. If, on the other hand, a low signal from the signal generating circuit 61 and a low signal from the changeover circuit 58 are both input to the OR circuit 62, the changeover switch 63 is turned off and thus, the changeover circuit 16 is switched to the terminal a.

In the fifth embodiment, if the engine is started up while the engine coolant temperature is still lower than the predetermined level, the low signals alone are input to the OR circuit 62 and, as a result, the changeover switch 63 is turned off. Since this ensures that the setting at the changeover circuit 16 remains at the terminal a even if the gate lock lever 6 is operated to the lock position and the fuel lever 8 is operated to the idle position, the engine speed is not set to the super low idle rotation rate NS but is controlled to remain at the low idle rotation rate NL. As a result, an engine stall does not occur at engine startup.

Once the predetermined length of time has elapsed after startup of the engine 1, the warm-up operation ends and the engine speed stabilizes. In this state, a high signal is input from the changeover circuit 58 to the OR circuit 62, and thus, the changeover switch 63 enters an ON state. If the gate lock lever 6 is set at the lock position and the fuel lever 8 is set at the idle position in this situation, the changeover circuit 16 is switched to the terminal b and control is executed so as to adjust the engine speed to the super low idle rotation rate NS. Thus, better fuel efficiency is achieved while preventing engine stall at startup. Under the control executed by the engine control device, a high signal is input from the signal generating circuit 61 to the OR circuit 62, thereby setting the changeover switch 63 to an ON state, if the engine coolant temperature exceeds the predetermined level even before the predetermined length of time is counted. Since the engine speed is set to the super low idle rotation rate NS before the predetermined length of time elapses, even better fuel efficiency is achieved in this case.

It is to be noted that if the engine ignition switch 52 is turned on again without allowing the engine ignition switch 52 to remain in an OFF state for a significant length of time, the engine 1 may not be completely cooled down, and the engine coolant temperature may still be higher than the predetermined level. Under such circumstances, the engine speed is immediately adjusted to the super low idle rotation rate NS as the engine ignition switch 52 is turned on.

As described above, control is executed so as not to allow the engine speed to be set to the super low idle rotation rate NS and to sustain it to a level at least equal to or higher than the low idle rotation rate NL until the predetermined length of time elapses after starting up the engine 1 or until the warm-up operation is completed in the fifth embodiment. Thus, an engine stall at engine startup is effectively prevented. In addition, when the predetermined length of time elapses or when the engine coolant temperature becomes equal to or higher than the predetermined level even before the predetermined length of time elapses, the engine speed is allowed to be set to the super low idle rotation rate NS, thereby effectively improving the fuel efficiency.

It is to be noted that while the changeover circuit 16 is switched in response to operations of the gate lock lever 6 and the fuel lever 8 in the control device shown in FIG. 9, the changeover circuit 16 may also be switched in response to an operation of the brake switch 18 or the forward/reverse changeover switch 19, described earlier in reference to FIGS. 4, 6 and 7, and in response to operations of the gate lock lever 6 and the fuel lever 8.

Figure 10:
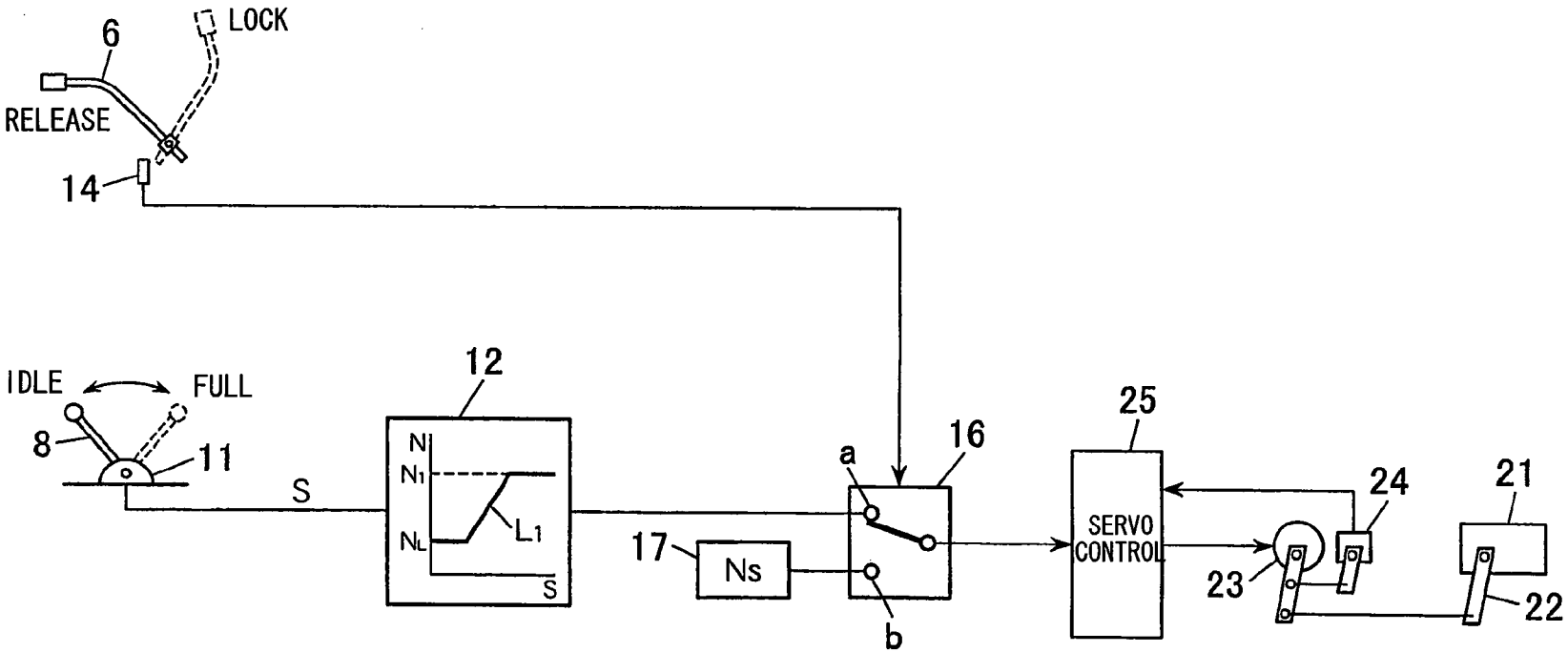

While the drive of the hydraulic actuators 5 on the pressure oil supplied from the hydraulic pump 2 becomes disallowed as the lock valve 3 is engaged in operation in the embodiment explained in reference to FIGS. 1 and 2, another type of drive disallowing means may be utilized instead. In addition, while the operating/non-operating state of the lock valve 3 is detected via the limit switch 14, a disallowed drive detection means other than this may be utilized. While control is executed so as to adjust the engine speed to the super low idle rotation rate NS when the gate lock lever 6 has been set to the lock position and the fuel lever 8 has been set to the idle position, control may be executed so as to adjust the engine speed to the super low idle rotation rate NS on the sole condition that the gate lock lever 6 has been set at the lock position, as shown in FIG. 10. Namely, the rotation rate control means may adopt a structure other than that described above as long as control is executed so as to adjust the engine speed to the super low idle rotation rate NS (low rotation rate) once engagement of at least the drive disallowing means is detected.

Figure 11:
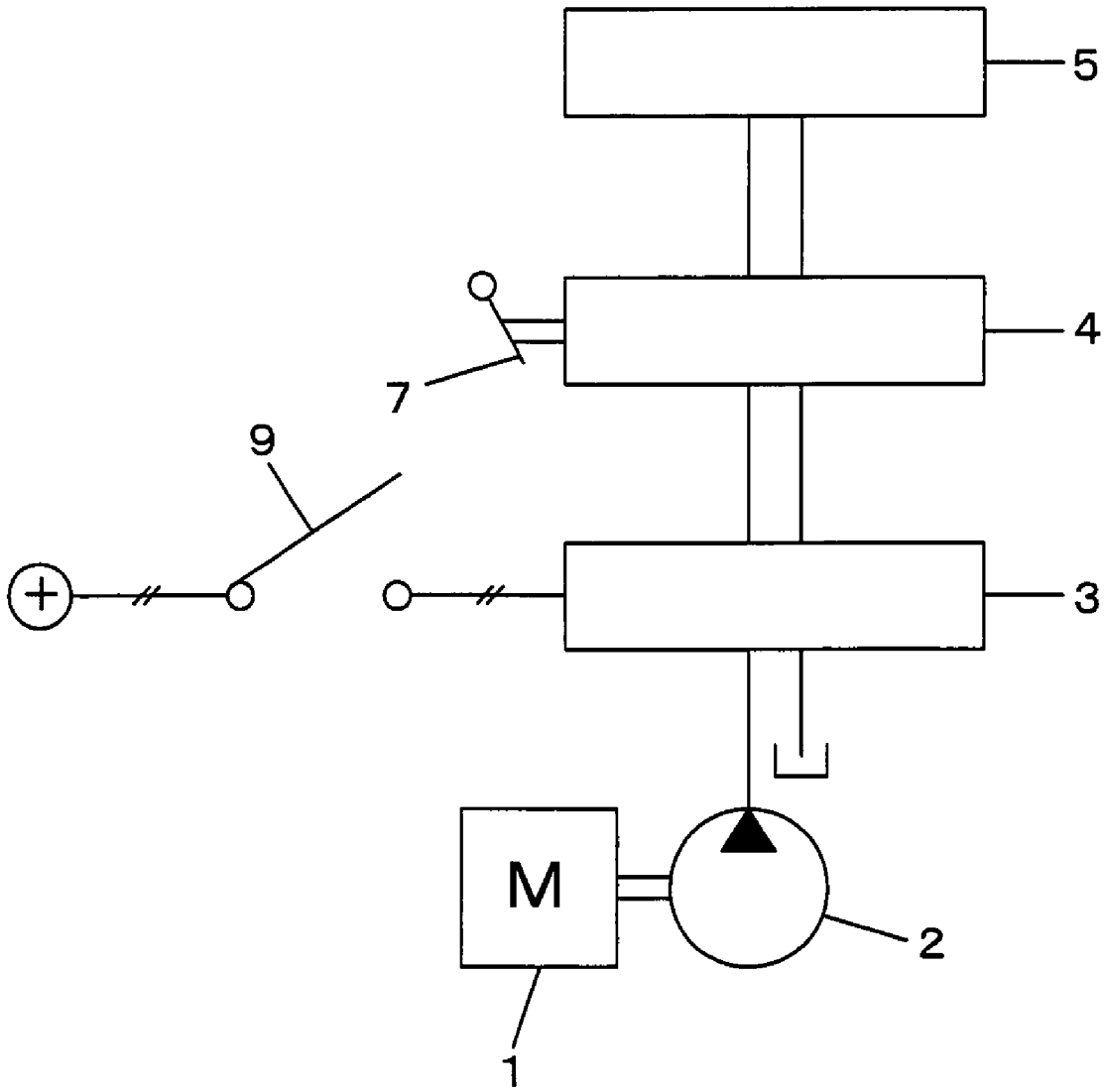

While the lock valve 3 is set in the operating/non-operating state by interlocking with an operation of the gate lock lever 6 in the embodiment explained earlier in reference to FIG. 2, the engine control device may include a super low switch 9 such as that shown in FIG. 11, so as to set the lock valve 3 in the operating state or the non-operating state in response to an operation of the super low switch 9. In this case, the operating/non-operating state of the lock valve 3 is detected via the super low switch 9.

Sixth Embodiment

Figure 12:
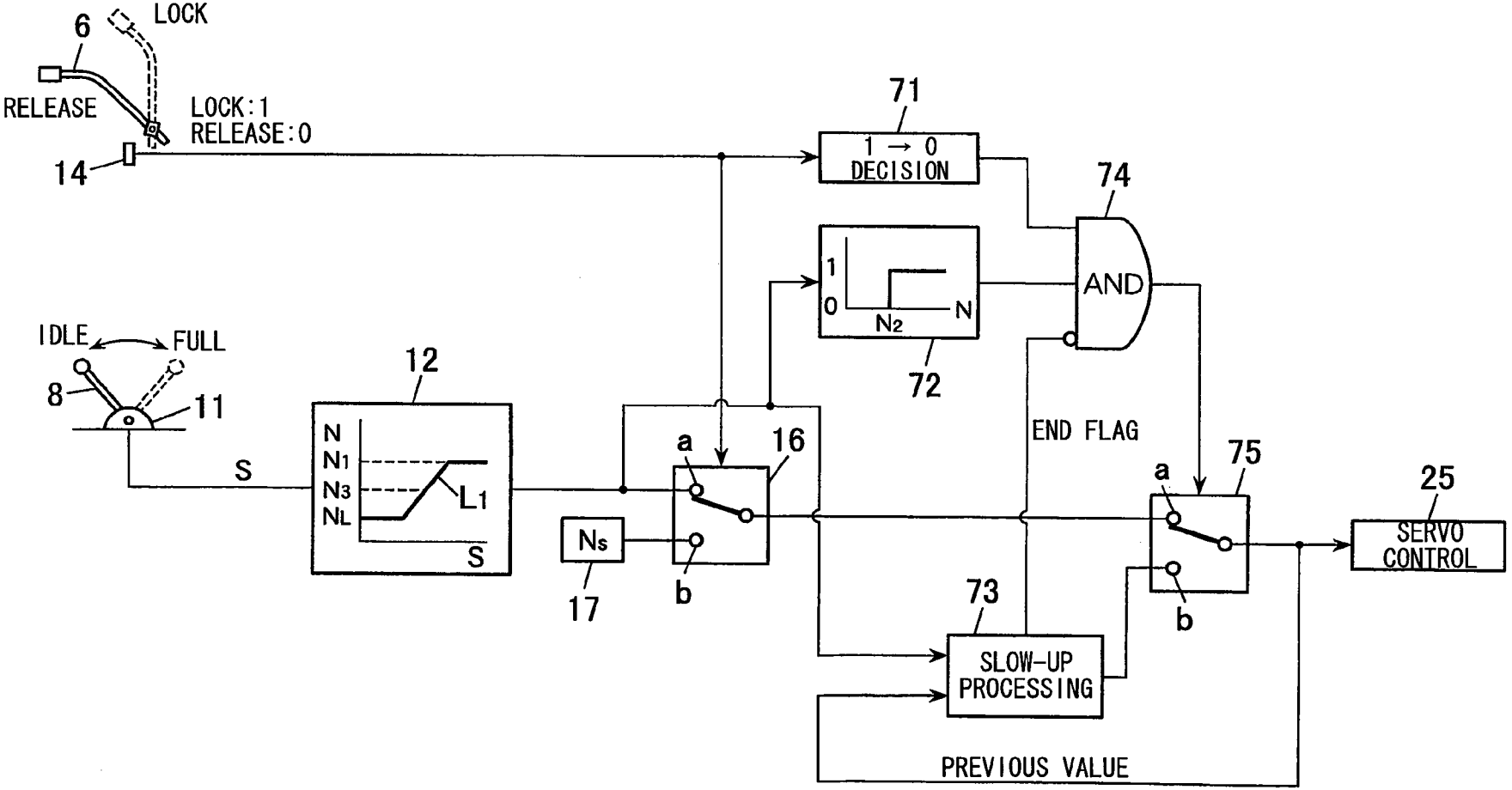
Figure 13:
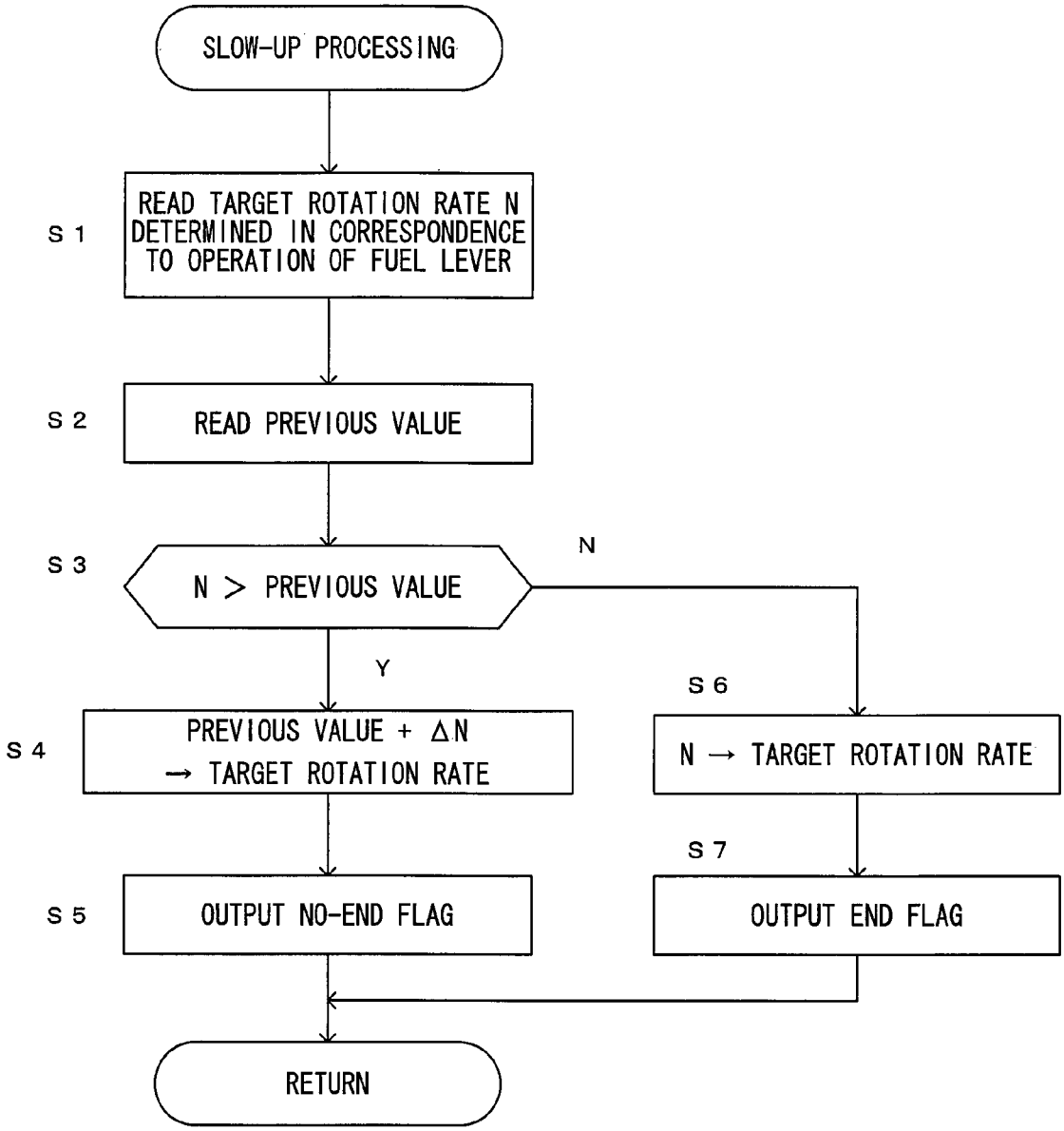

In reference to FIGS. 12 and 13, the sixth embodiment of the engine control device for a work vehicle according to the present invention is explained.

When control is executed so as to adjust the engine speed to the super low idle rotation rate NS on the sole condition that the gate lock lever 6 has been set to the lock position, as described above (see FIG. 10), the engine speed is controlled at the super low idle rotation rate NS even if the fuel lever 8 is set to a position (e.g., the full position) other than the idle position. As the gate lock lever 6 is set to the release position and the target rotation rate N corresponding to the extent to which the fuel lever 8 has been operated is immediately output as the command value for the engine speed in this state, the quantity of fuel being supplied will increase at once, resulting in an excessive load (stress) applied to the engine, which is bound to adversely affect the engine strength and performance. By taking this factor into consideration, an engine speed reset operation is controlled as detailed below in the sixth embodiment.

FIG. 12 is a block diagram showing the structure adopted in the engine control device achieved in the sixth embodiment. It is to be noted that the same reference numerals are assigned to components identical to those in FIG. 10 and that the following explanation focuses on features characterizing the sixth embodiment.

As shown in FIG. 12, a signal from the limit switch 14 is input to a decision-making circuit 71 which then makes a decision as to whether or not the limit switch 14 has shifted from an ON state (gate lock lever at the lock position) to an OFF state (gate lock lever at the release position), i.e., whether or not a changeover from the flag 1 to the flag 0 is to occur. A signal from the function generating circuit 12, indicating the target rotation rate N corresponding to the operation quantity S, is input to a signal generating circuit 72 and is also input to a slow-up processing circuit 73. The signal generating circuit 72 outputs a high signal (1) when the target rotation rate N is equal to or higher than a predetermined rotation rate N2 but outputs a low signal (0) when the target rotation rate is less than the preset rotation rate N2. The preset rotation rate N2 represents the upper limit (e.g., 1400 rpm), to the target rotation rate N, at which no engine problem occurs even if the engine speed is raised from the super low idle rotation rate NS by a large extent at once.

The slow-up processing circuit 73 outputs a target rotation rate determined through processing to be detailed later to a changeover circuit 75 and also provides an AND circuit 74 with an inverted output of an end flag (1) or a no-end flag (0) indicating that the processing has ended/not ended. In response to signals provided from the decision-making circuit 71, the function generating circuit 72 and the slow-up processing circuit 73, the AND circuit 74 switches the changeover circuit 75. Namely, if a flag 1 is input from both the decision-making circuit 71 and the function generating circuit 72 and the flag 0 (inverted flag 1) is input from the slow-up processing circuit 73, the AND circuit 74 switches the changeover circuit 75 to the terminal b. In response, the changeover circuit 75 outputs the target rotation rate provided from the slow-up processing circuit 73 to the servo control circuit 25. Under any other conditions, the AND circuit 74 switches the changeover circuit 75 to the terminal a. In response, the changeover circuit 75 outputs the target rotation rate provided from the changeover circuit 16 to the servo control circuit 25. It is to be noted that the changeover circuit 75 also outputs the target rotation rate to the slow-up processing circuit 73 where it is held as a previous value. As described earlier, the servo control circuit 25 controls the rotation of the pulse motor 23 in correspondence to the target rotation rate.

In reference to the flowchart presented in FIG. 13, the processing executed in the slow-up processing circuit 73 is explained. First, the target rotation rate N corresponding to the operation quantity S indicating the extent to which the fuel lever 8 has been operated is read in step S1, and then, the previous value having been output from the changeover circuit 75 is read in step S2. Next, a decision is made in step S3 as to whether or not the target rotation rate N is greater than the previous value. If an affirmative decision is made in step S3, the operation proceeds to step S4 to add a predetermined value ΔN to the previous value and outputs the sum as the target rotation rate. It is to be noted that the predetermined level ΔN indicates the rate (e.g., 100 rpm/sec) at which the target rotation rate N increases in response to a manual operation of the fuel lever 8, and thus, the target rotation rate increases proportionally at the rate ΔN. In step S5, the no-end flag is output. If, on the other hand, a negative decision is made in step S3, the operation proceeds to step S6 to output the target rotation rate N corresponding to the operation quantity S as the target rotation rate. Then, the end flag is output in step S7.

In the sixth embodiment, the changeover circuit 16 is switched to the terminal b, the changeover circuit 75 is switched to the terminal a, and control is executed so as to adjust the engine speed to the super low idle rotation rate NS as the gate lock lever 6 is operated to the lock position regardless of the setting assumed by the fuel lever 8. Once the gate lock lever 6 is set to the release position, the changeover circuit 16 is switched to the terminal a and the target rotation rate N, corresponding to the operation quantity reflecting the extent to which the fuel lever 8 has been operated, is input to the changeover circuit 75.

In this situation, if the target rotation rate N is equal to or higher than the preset rotation rate N2, the changeover circuit 75 is switched to the terminal b and slow-up processing for the engine speed is started. Namely, the target rotation rate output from the slow-up processing circuit 73 gradually increases (step S4), thereby gradually raising the engine speed. Thus, no excessive load is applied to the engine. Once the target rotation rate provided from the slow-up processing circuit 73 reaches the target rotation rate N corresponding to the operation quantity reflecting the extent to which the fuel lever 8 has been operated, the end flag is output (step S7) and the changeover circuit 75 is switched to the terminal a. Subsequently, the engine speed is controlled at the target rotation rate N.

If, on the other hand, the target rotation rate N determined in correspondence to the operation of the fuel lever 8, which is input to the changeover circuit 75 when the gate lock lever 6 is set to the release position, is less than the preset rotation rate N2, the changeover circuit 75 is switched to the terminal a, and the target rotation rate N is directly output from the changeover circuit 75. In response, the engine speed is immediately controlled so as to adjust it to the rotation rate corresponding to the extent to which the fuel lever 8 has been operated, thereby quickly enabling the work operation. In this situation, the difference between the super low idle rotation rate NS and the target rotation rate N is small and thus, no problem occurs even if the engine speed is raised to the target rotation rate N at once.

As described above, as the gate lock lever 6 is operated to the release position, the engine speed is gradually increased from the super low idle rotation rate NS to the target rotation rate N and thus, no excessive load is applied to the engine in the sixth embodiment. In addition, if the target rotation rate N is less than the preset rotation rate N2, the engine speed is raised at once from the super low idle rotation rate NS to the target rotation rate N. In other words, under circumstances in which the load on the engine is not significant, control is executed so as to immediately adjust the engine speed to the target rotation rate N to quickly enable the work operation.

Seventh Embodiment

Figure 14:
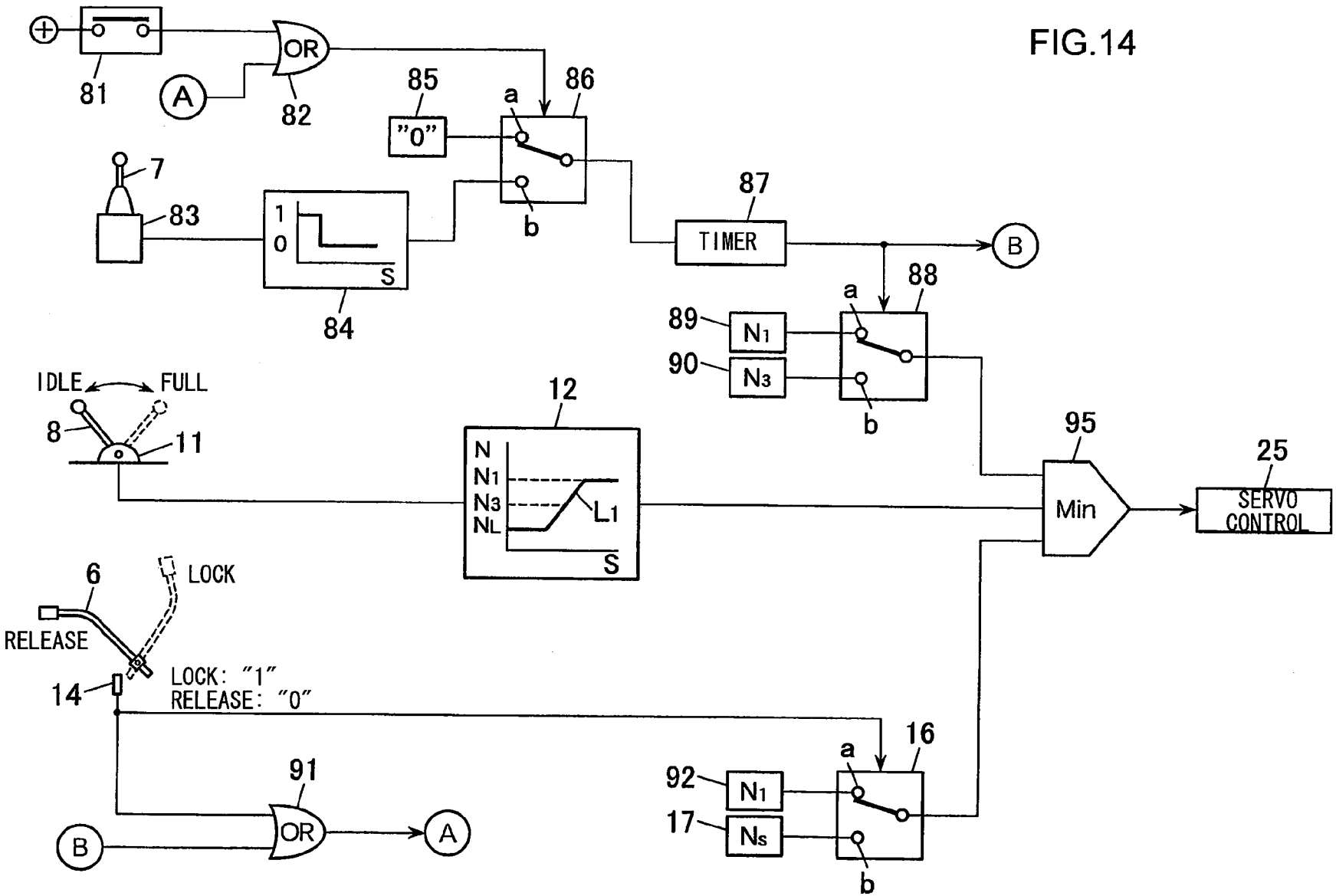

In reference to FIG. 14, the seventh embodiment of the engine control device for a work vehicle according to the present invention is explained.

While the engine speed is gradually increased from the super low idle rotation rate NS to the target rotation rate N in the engine speed reset operation in the sixth embodiment, the engine speed is increased to a preset rotation rate (auto-idle rotation rate) which is lower than the target rotation rate N in the seventh embodiment.

FIG. 14 is a block diagram showing the structure adopted in the engine control device achieved in the seventh embodiment. It is to be noted that the same reference numerals are assigned to components identical to those in FIG. 10 and that the following explanation focuses on features characterizing the seventh embodiment.

A signal from an auto-idle switch 81, through which an auto idle control command is issued, and a signal from an OR circuit 91 are input to an OR circuit 82. The auto idle control, under which the engine speed is regulated to achieve a predetermined rotation rate (auto idle rotation rate N3) when the engine is rotating at high speed and the operating lever 7 is sustained in the neutral state over a predetermined length of time t and the engine speed is then reset to a high rotation rate as the operating lever 7 having been sustained in the neutral state is then operated, is executed as follows.

An operation quantity detector 83 detects the operation quantity representing the extent to which the operating lever 7 has been operated. A signal generating circuit 84 outputs a high signal (1) to a changeover circuit 86 when the operating lever 7 is in a non-operating (neutral) state and outputs a low signal (0) to the changeover circuit 86 as the operating lever 7 is operated. As the auto idle switch 81 outputs an ON signal or a high signal is output from the OR circuit 91, the OR circuit 82 switches the changeover circuit 86 to the terminal b, but the OR circuit 82 switches the changeover circuit 86 to the terminal a otherwise. As a high signal is output from the signal generating circuit 84 after the changeover circuit 86 is switched to the terminal b, a timer 87 starts a count and the timer is then reset in response to an output of a low signal. The timer is also reset when the changeover circuit 86 is switched to the terminal a.

Upon counting a predetermined length of time t (e.g., 3 sec), the timer 87 outputs a high signal (1) to a changeover circuit 88, thereby switching the changeover circuit 88 to the terminal b. The timer outputs a low signal (0) until the predetermined length of time t elapses so as to set the changeover circuit 88 to the terminal a. As soon as the changeover circuit 88 is switched to the terminal b, the changeover circuit 88 outputs the auto idle rotation rate N3 set at a signal generating circuit 90, whereas as soon as it is switched to the terminal a, it outputs a rated rotation rate N1 set at a signal generating circuit 89. As is the preset rotation rate N2 in the sixth embodiment, the auto idle rotation rate N3 may be set to 1400 rpm.

The signal from the timer 87 and the signal from the limit switch 14 are input to the OR circuit 91, and after the timer 87 counts the predetermined length of time t or as the limit switch 14 is turned on, the OR circuit 91 outputs a high signal to the OR circuit 82. The changeover circuit 16 is switched to the terminal a in response to a release operation of the gate lock lever 6 and outputs the rated rotation rate N1 set at a signal generating circuit 92 in advance. In response to a lock operation of the gate lock lever 6, the changeover circuit 16 is switched to the terminal b and outputs the super low idle rotation rate NS. A minimum value selection circuit 95 selects the rotation rate indicating the smallest value among the rotation rate output from the changeover circuit 88, the rotation rate output from the function generating circuit 12 and the rotation rate output from the changeover circuit 16 and outputs the selected rotation rate to the servo control circuit 25 to be used as the target rotation rate.

In the seventh embodiment, in response to a lock operation of the gate lock lever 6, the changeover circuit 16 is switched to the terminal b and the super low idle rotation rate NS is output from the changeover circuit 16. In addition, in response to a lock operation of the gate lock lever 6, the changeover circuit 86 is switched to the terminal b and when the operating lever 7 has remained at the neutral position over the predetermined length of time t, the auto idle rotation rate N3 is output from the changeover circuit 88. Under these circumstances, the minimum value selection circuit 95 selects the super low idle rotation rate NS so as to execute control to adjust the engine speed to the super low idle rotation rate NS.

As the gate lock lever 6 is operated to the release position in this state, the minimum value selection circuit 95 selects the auto idle rotation rate N3 so as to execute control to adjust the engine speed to the auto idle rotation rate N3 if the target rotation rate N determined in correspondence to the operation of the fuel lever 8 is greater than the preset rotation rate N3. Under these circumstances, the extent to which the engine speed is allowed to increase is restricted and thus, the load applied to the engine is reduced. As the operating lever 7 is operated under these conditions, the changeover circuit 88 is switched to the terminal a so as to execute control to adjust the engine speed to the target rotation rate N corresponding to the extent to which the fuel lever 8 has been operated.

The minimum value selection circuit 95 selects the target rotation rate N output from the function generating circuit 12 in response to a release operation of the gate lock lever 6 if the target rotation rate N determined in correspondence to the operation of the fuel lever 8 is less than the preset rotation rate N3. In this case, control is executed so as to adjust the engine speed to the target rotation rate N corresponding to the extent to which the fuel lever 8 has been operated. Under these circumstances, the engine speed remains unchanged even when the operating lever 7 is operated. It is to be noted that an operation of the auto idle switch 81 does not bear any relation to the operations described above.

In the seventh embodiment described above, control is executed so as to switch the engine speed from the super low idle rotation rate NS to the auto idle rotation rate N3 in response to a release operation of the gate lock lever 6, thereby preventing an excessive load from being applied to the engine. In addition, the engine speed is held at the auto idle rotation rate N3 (auto idle control) until the operating lever 7 is operated. As a result, better fuel efficiency is achieved and, at the same time, noise is reduced. Control is executed so as to adjust the engine speed to the target rotation rate N as long as the target rotation rate N is less than the preset rotation rate N3, regardless of the operating status of the operating lever 7. Thus, if the load on the engine is not significant, the engine speed can be immediately set to the target rotation rate N.

It is to be noted that while the target rotation rate, the lower limit of which is the low idle rotation rate NL, is indicated in a command in response to an operation of the fuel lever 8 in the embodiment described earlier in reference to FIG. 1, the rotation rate command issuing means may take on a structure other than this. The characteristics in conformance to which the target rotation rate is set simply represent an example, and the target rotation rate corresponding to the extent to which the fuel lever 8 has been operated may be set in conformance to another set of characteristics. In addition, the engine speed may be controlled so as to achieve a value other than a command value indicated by the operator, as long as the engine speed is adjusted to a preset rotation rate at least equal to or higher than the low idle rotation rate NL upon detecting the lock valve 3 in a non-operating state.

While the parking brake and the work brake are detected to be in an engaged state or in a non-engaged state by checking the operational state of the brake switch 18 in the embodiment described earlier in reference to FIG. 4, the braking detection means may adopt a structure other than this. For instance, a braking device may be provided in correspondence to a hydraulic actuator 5 other than the traveling motor 33 and, in this case, the engine speed may be adjusted to the super low idle rotation rate NS upon detecting engagement of this braking device.

While the forward/reverse changeover switch 19 is operated to select a traveling-enabled state in which the traveling motor 33 is allowed to rotate or a neutral state in which the traveling motor is not allowed to rotate, the forward/reverse switching valve 34 and the directional control valve 32 are switched based upon the selection made at the forward/reverse changeover switch 19 and the flow of the pressure oil from the hydraulic pump 2 to the traveling motor 33 is either allowed or disallowed accordingly in the embodiment described earlier in reference to FIGS. 5 and 6, the traveling selection means and the traveling control means may each adopt a structure other than that explained in reference to the embodiment.

While either the target rotation rate set in correspondence to the engine coolant temperature or the target rotation rate set in correspondence to the hydraulic fluid temperature, whichever indicates a greater value, is set as the correction value to be used to correct the super low idle rotation rate NS in the embodiment described earlier in reference to FIG. 8, either the target rotation rate set in correspondence to the engine coolant temperature or the target rotation rate set in correspondence to the hydraulic fluid temperature may simply be selected in the first place as the correction value to be used to correct the super low idle rotation rate instead. While the engine coolant temperature is detected with the coolant temperature sensor 41, the coolant temperature detection means may adopt a structure other than this. While the hydraulic fluid temperature is detected with the hydraulic fluid temperature sensor 42, the oil temperature detection means may adopt a structure other than this. The characteristics L2 and L3 in conformance to which the target rotation rates are set simply represent examples and target rotation rates corresponding to the engine coolant temperature and the hydraulic fluid temperature may instead be set in conformance to other sets of characteristics.

While a switchover to the super low idle rotation rate NS is allowed once the predetermined length of time elapses after detecting startup of the engine 1 or once the detection value provided by the coolant temperature sensor 41 becomes equal to or higher than the predetermined level in the embodiment described earlier in reference to FIG. 9, the switchover to the super low idle rotation rate NS may be allowed only if the predetermined length of time elapses after detecting startup of the engine 1 or only if the detection value provided by the coolant temperature sensor 41 becomes equal to or higher than the predetermined level, instead. While the startup of the engine 1 is detected at the engine ignition switch 52, another startup detection means may be utilized. In addition, while the coolant temperature sensor 41 detects the completion of the warm-up operation, another warm-up operation completion decision-making means may be utilized.

While the engine speed is proportionally increased to the target rotation rate N corresponding to the extent to which the fuel lever 8 has been operated, i.e., to the command rotation rate, when resetting the engine speed currently at the super low idle rotation rate NS in the embodiment described earlier in reference to FIG. 12, another rotation rate increase pattern may be adopted as long as the engine speed is gradually raised.

While control is executed so as to adjust the engine speed to the auto idle rotation rate N3 if the target rotation rate N determined in correspondence to the operation of the fuel lever 8 is greater than the auto idle rotation rate N3 when resetting the engine speed currently at the super low idle rotation rate NS in the embodiment described earlier in reference to FIG. 14, control may instead be executed so as to adjust the engine speed to a rotation rate other than the auto idle rotation rate as long as it is adjusted to a rotation rate higher than the low idle rotation rate NL and lower than the target rotation rate N determined in correspondence to the operation of the fuel lever 8. Namely, while the preset rotation rate N3 used in the auto idle control is also utilized in the control executed in the embodiment, a special preset rotation rate N3 may be selected separately without executing any auto idle control. While the drive command for the hydraulic actuators is output via the operating lever 7, an actuator drive command may be output via a structure other than this.

INDUSTRIAL APPLICABILITY

The present invention may also be adopted just as effectively in another type of work vehicle provided with a hydraulic pump 2 driven by an engine 1 and a hydraulic actuator 5 driven with pressure oil supplied from the hydraulic pump 2.

The disclosure of the following priority application is herein incorporated by reference:

Japanese Patent Application No. 2004-279087

The invention claimed is:

1. An engine control device for a work vehicle, comprising:

a hydraulic pump driven by an engine;

a hydraulic actuator driven with pressure oil supplied from the hydraulic pump;

a control valve that controls flow of the pressure oil from the hydraulic pump to the hydraulic actuator in accordance with operation of an operating member;

a drive disallowing device that disallows drive of the hydraulic actuator with the pressure oil supplied in accordance with the operation of the operating member from the hydraulic pump;

a disallowed drive detection device that detects whether or not the drive disallowing device is disallowing the drive;

a rotation rate command issuing device that issues a command indicating a rotation rate to be achieved for the engine within a range, a lower limit of which is equal to a low idle rotation rate, in response to an operation performed by an operator, with the low idle rotation rate being a minimum rotation rate at which the hydraulic actuator can still be driven; and a rotation rate control device that executes control so as to adjust an engine speed to a low rotation rate, which is lower than the low idle rotation rate and at which an engine stall will occur if a load is applied to the hydraulic actuator, when the disallowed drive detection device detects that the drive disallowing device is disallowing the drive and the rotation rate command issuing device issues a command indicating the low idle rotation rate, and when the rotation rate command issuing device issues a command indicating a rotation rate higher than the low idle rotation rate, the rotation rate control device controls the engine speed so as to adjust the engine speed to the rotation rate indicated in the command, wherein:

the rotation rate control device controls the engine speed to the low idle rotation rate when the disallowed drive detection device detects that the drive disallowing device is not disallowing the drive while the engine speed is controlled to the low rotation rate; and when the rotation rate command issuing device issues a command indicating a rotation rate higher than the low idle rotation rate while the engine speed is controlled to the low rotation rate, the rotation rate control device adjusts the engine speed to the rotation rate indicated in the command, and then the rotation rate control device maintains the engine speed to be the rotation rate indicated in the command even if the disallowed drive detection device detects that the drive disallowing device is not disallowing the drive.

2. An engine control device for a work vehicle according to claim 1, further comprising:

a braking device that applies a brake on the hydraulic actuator; and a braking detection device that detects whether or not the braking device is engaged in operation, wherein:

as the disallowed drive detection device detects that the drive disallowing device is disallowing the drive, the rotation rate command issuing device issues a command indicating the low idle rotation rate and the braking detection device detects that the braking device is engaged in operation, the rotation rate control device controls the engine speed so as to adjust the engine speed to the low rotation rate.

3. An engine control device for a work vehicle according to claim 1, further comprising:

the hydraulic actuator constituted with a traveling motor that rotates in correspondence to an extent to which a traveling pedal has been operated;

a traveling selection device that selects one of a traveling-enabled state in which the traveling motor is allowed to rotate in response to an operation of the traveling pedal and a neutral state in which the traveling motor is not allowed to rotate; and a traveling control device that allows a flow of pressure oil from the hydraulic pump to the traveling motor when the traveling-enabled state is selected via the traveling selection device and disallows the flow of pressure oil from the hydraulic pump to the traveling motor when the neutral state is selected via the traveling selection device, wherein:

as the disallowed drive detection device detects that the drive disallowing device is disallowing the drive, the rotation rate command issuing device issues a command indicating the low idle rotation rate and the neutral state is selected via the traveling selection device, the rotation rate control device controls the engine speed so as to adjust the engine speed to the low rotation rate.

4. An engine control device for a work vehicle according to claim 1, further comprising:

a coolant temperature detection device that detects an engine coolant temperature; and a first setting device that sets the low rotation rate in correspondence to the engine coolant temperature so as to adjust the low rotation rate to a higher setting as the engine coolant temperature detected by the coolant temperature detection device decreases, wherein:

when adjusting the engine speed to the low rotation rate, the rotation rate control device controls the engine speed so as to adjust the engine speed to the rotation rate set via the first setting device.

5. An engine control device for a work vehicle according to claim 1, further comprising:

a hydraulic fluid temperature detection device that detects a hydraulic fluid temperature; and a second setting device that sets the low rotation rate in correspondence to the hydraulic fluid temperature so as to adjust the low rotation rate to a higher setting as the hydraulic fluid temperature detected by the hydraulic fluid temperature detection device decreases, wherein:

when adjusting the engine speed to the low rotation rate, the rotation rate control device controls the engine speed so as to adjust the engine speed to the rotation rate set via the second setting device.

6. An engine control device for a work vehicle according to claim 1, further comprising:

a startup detection device that detects a startup of the engine, wherein:

the rotation rate control device disallows a switchover of the engine speed to the low rotation rate until a predetermined length of time elapses after the startup detection device detects the startup of the engine and allows the switchover to the low rotation rate once the predetermined length of time elapses after the startup detection device detects the startup of the engine.

7. An engine control device for a work vehicle according to claim 1, further comprising:

a warm-up operation decision-making device that makes a decision as to whether a warm-up operation at the engine has been completed, wherein:

the rotation rate control device disallows a switchover of the engine speed to the low rotation rate until the warm-up operation decision-making device determines that the warm-up operation has been completed and allows the switchover to the low rotation rate once the warm-up operation decision-making device determines that the warm-up operation has been completed.

8. An engine control device for a work vehicle according to claim 1, wherein:

if at least the disallowed drive detection device detects that the drive disallowing device is not disallowing the drive, the rotation rate control device controls the engine speed so as to adjust the engine speed to a preset rotation rate equal to or higher than the low idle rotation rate.

9. An engine control device for a work vehicle, comprising:

a hydraulic pump driven by an engine a hydraulic actuator driven with pressure oil supplied from the hydraulic pump;

a drive disallowing device that disallows drive of the hydraulic actuator with the pressure oil supplied from the hydraulic pump;

a disallowed drive detection device that detects whether or not the drive disallowing device is disallowing the drive;

a rotation rate control device that executes control so as to adjust an engine speed to a low rotation rate, lower than a minimum, low idle rotation rate at which the hydraulic actuator can still be driven, at least when the disallowed drive detection device detects that the drive disallowing device is disallowing the drive; and a rotation rate command issuing device that issues a command indicating a rotation rate to be achieved for the engine within a range, a lower limit of which is equal to the low idle rotation rate, in response to an operation performed by an operator, wherein:

as the disallowed drive detection device detects that the drive disallowing device is not disallowing the drive while the engine speed is controlled at the low rotation rate, (a) the rotation rate control device gradually increases the engine speed to the rotation rate indicated in the command issued by the rotation rate command issuing device when the rotation rate indicated in the command issued by the rotation rate command issuing device is equal to or higher than a reset rotation rate higher than the low idle rotation rate, and (b) if the rotation rate indicated in the command is less than the preset rotation rate, the rotation rate control device immediately increases the engine speed to the rotation rate indicated in the command.

10. An engine control device for a work vehicle, comprising:

a hydraulic pump driven by an engine;

a hydraulic actuator driven with pressure oil supplied from the hydraulic pump;

an actuator drive command issuing device that outputs a drive command for driving the hydraulic actuator;

a drive disallowing device that disallows drive of the hydraulic actuator with the pressure oil supplied from the hydraulic pump;

a disallowed drive detection device that detects whether or not the drive disallowing device is disallowing the drive;

a rotation rate control device that executes control so as to adjust an engine speed to a low rotation rate, lower than a minimum low idle rotation rate at which the hydraulic actuator can still be driven, at least when the disallowed drive detection device detects that the drive disallowing device is disallowing the drive; and a rotation rate command issuing device that issues a command indicating a rotation rate to be achieved for the engine within a range, a lower limit of which is equal to the low idle rotation rate, in response to an operation performed by an operator, wherein:

when the disallowed drive detection device detects that the drive disallowing device is not disallowing the drive while no drive command has been output from the actuator drive command issuing device over a predetermined length of time, the rotation rate control device controls the engine speed so as to adjust the engine speed to a preset rotation rate higher than the low idle rotation rate if the rotation rate indicated in the command issued by the rotation rate command issuing device is equal to or higher than the preset rotation rate;

as the disallowed drive detection device detects that the drive disallowing device is not disallowing the drive while the engine speed is controlled at the low rotation rate, the rotation rate control device controls the engine speed so as to adjust the engine speed to the preset rotation rate; and when the actuator drive command issuing device outputs the drive command while the engine speed is controlled at the preset rotation rate, the rotation rate control device controls the engine speed so as to adjust the engine speed to the rotation rate indicated in the command issued by the rotation rate command issuing device.

11. An engine control device for a work vehicle according to claim 10, wherein:

when the disallowed drive detection device detects that the drive disallowing device is not disallowing the drive while the engine speed is controlled at the low rotation rate, (a) the rotation rate control device controls the engine speed so as to adjust the engine speed to the preset rotation rate if the rotation rate indicated in the command issued by the rotation rate command issuing device is equal to or higher than the preset rotation rate, and (b) the rotation rate control device controls the engine speed so as to adjust the engine speed to the rotation rate indicated in the command if the rotation rate indicated in the command issued by the rotation rate command issuing device is lower than the preset rotation rate.

* * * * *